US008979657B2

(12) United States Patent
Englman et al.

(10) Patent No.: US 8,979,657 B2
(45) Date of Patent: Mar. 17, 2015

(54) WAGERING GAME WITH COMMUNITY EVENT POKER GAME

(75) Inventors: Allon G. Englman, Chicago, IL (US); Benjamin T. Gomez, Chicago, IL (US); James V. Palermo, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 762 days.

(21) Appl. No.: 12/741,886

(22) PCT Filed: Nov. 3, 2008

(86) PCT No.: PCT/US2008/082222

§ 371 (c)(1), (2), (4) Date: May 7, 2010

(87) PCT Pub. No.: WO2009/061696

PCT Pub. Date: May 14, 2009

(65) Prior Publication Data

US 2011/0130192 A1 Jun. 2, 2011

Related U.S. Application Data

(60) Provisional application No. 61/002,350, filed on Nov. 8, 2007, provisional application No. 61/124,693, filed on Apr. 18, 2008, provisional application No. 61/188,126, filed on Aug. 6, 2008, provisional application No. 61/108,970, filed on Oct. 28, 2008.

(51) Int. Cl.
*A63F 9/24* (2006.01)
*G07F 17/32* (2006.01)

(52) U.S. Cl.
CPC ..... *G07F 17/3223* (2013.01); *G07F 17/3258* (2013.01); *G07F 17/32* (2013.01); *G07F 17/3244* (2013.01)
USPC ..... 463/42; 463/20; 463/25

(58) Field of Classification Search
CPC ..... G07F 17/32; G07F 17/3258
USPC ..... 463/37, 16, 42
See application file for complete search history.

(56) References Cited

U.S. PATENT DOCUMENTS 4,624,459 A 11/1986 Kaufman ..... 273/143 R
4,743,022 A 5/1988 Wood ..... 273/85

(Continued)

FOREIGN PATENT DOCUMENTS

CA 2334546 A1 8/2001 ..... G01F 17/34
DE 195 15 983 A1 11/1996 ..... G07F 17/34

(Continued)

OTHER PUBLICATIONS

Article for "Easy Riches" by Sigma Game, Strictly Slots, 1 page (Aug. 2001).

(Continued)

*Primary Examiner* — Lawrence Galka
(74) *Attorney, Agent, or Firm* — Nixon Peabody LLP

(57) ABSTRACT

A gaming system for conducting a wagering game includes a display for displaying a base game of the wagering game in response to receiving a wager input from a player and a controller coupled to the display. The controller is programmed to randomly increment during game play a bonus-time eligibility counter for a community bonus game, decrement the bonus-time eligibility counter as real time progresses, and render a player eligible to play the community bonus game if the bonus-time eligibility counter is greater than zero when a community bonus game is triggered.

23 Claims, 16 Drawing Sheets

(56) References Cited

U.S. PATENT DOCUMENTS

| | | | | | |
|---|---|---|---|---|---|
| 4,752,068 | A | | 6/1988 | Endo | |
| 4,837,728 | A | | 6/1989 | Barrie et al. | 364/412 |
| 4,861,041 | A | | 8/1989 | Jones et al. | 273/292 |
| 4,948,134 | A | | 8/1990 | Suttle et al. | 273/85 |
| 5,046,736 | A | * | 9/1991 | Bridgeman et al. | 463/13 |
| 5,116,055 | A | | 5/1992 | Tracy | 273/138 A |
| 5,249,800 | A | | 10/1993 | Hilgendorf et al. | 273/138 A |
| 5,275,400 | A | | 1/1994 | Weingardt | 273/85 |
| 5,280,909 | A | | 1/1994 | Tracy | 273/138 A |
| 5,294,120 | A | | 3/1994 | Schultz | 273/85 |
| 5,308,065 | A | | 5/1994 | Bridgeman et al. | 273/85 |
| 5,322,295 | A | | 6/1994 | Cabot et al. | 273/292 |
| 5,344,144 | A | | 9/1994 | Canon | 273/138 A |
| 5,377,973 | A | | 1/1995 | Jones et al. | 273/85 CP |
| 5,393,057 | A | | 2/1995 | Marnell, II | 273/85 CP |
| 5,401,023 | A | | 3/1995 | Wood | 273/85 |
| 5,417,430 | A | | 5/1995 | Breeding | 273/292 |
| 5,431,408 | A | | 7/1995 | Adams | 273/306 |
| 5,437,451 | A | | 8/1995 | Fulton | 273/138 |
| 5,489,101 | A | | 2/1996 | Moody | 273/292 |
| 5,511,781 | A | | 4/1996 | Wood et al. | 273/85 |
| 5,524,888 | A | | 6/1996 | Heidel | 463/22 |
| 5,531,448 | A | | 7/1996 | Moody | 273/292 |
| 5,554,892 | A | | 9/1996 | Norimatsu | 307/115 |
| 5,564,700 | A | * | 10/1996 | Celona | 463/27 |
| 5,577,959 | A | | 11/1996 | Takemoto | 463/25 |
| 5,580,063 | A | | 12/1996 | Edwards | 273/378 |
| 5,580,309 | A | | 12/1996 | Piechowiak et al. | 463/16 |
| 5,609,525 | A | | 3/1997 | Ohno et al. | |
| 5,611,730 | A | | 3/1997 | Weiss | 463/20 |
| 5,645,486 | A | | 7/1997 | Nagao et al. | 463/27 |
| 5,647,592 | A | | 7/1997 | Gerow | 463/139 |
| 5,655,961 | A | | 8/1997 | Acres et al. | 463/27 |
| 5,718,631 | A | | 2/1998 | Invencion | |
| 5,732,950 | A | | 3/1998 | Moody | 273/292 |
| 5,766,076 | A | | 6/1998 | Pease et al. | 463/27 |
| RE35,864 | E | | 7/1998 | Weingardt | 463/27 |
| 5,779,549 | A | | 7/1998 | Walker et al. | 463/42 |
| 5,816,916 | A | | 10/1998 | Moody | 463/13 |
| 5,816,918 | A | | 10/1998 | Kelly et al. | 463/16 |
| 5,820,459 | A | | 10/1998 | Acres et al. | 463/25 |
| 5,823,873 | A | | 10/1998 | Moody | 463/13 |
| 5,823,874 | A | | 10/1998 | Adams | 463/17 |
| 5,830,063 | A | | 11/1998 | Byrne | 463/25 |
| 5,839,956 | A | | 11/1998 | Takemoto | 463/18 |
| 5,848,932 | A | | 12/1998 | Adams | 463/20 |
| 5,851,147 | A | | 12/1998 | Stupak | 463/13 |
| 5,855,515 | A | | 1/1999 | Pease et al. | 463/27 |
| 5,868,619 | A | | 2/1999 | Wood et al. | 463/13 |
| 5,876,284 | A | | 3/1999 | Acres et al. | 463/25 |
| 5,882,259 | A | | 3/1999 | Holmes, Jr. | 463/13 |
| 5,885,158 | A | | 3/1999 | Torango et al. | 463/25 |
| 5,941,773 | A | | 8/1999 | Harlick | 463/26 |
| 5,944,606 | A | | 8/1999 | Gerow | 463/27 |
| 5,951,011 | A | | 9/1999 | Potter et al. | 273/292 |
| 5,954,335 | A | | 9/1999 | Moody | 273/292 |
| 5,957,774 | A | | 9/1999 | Holmes, Jr. et al. | 463/13 |
| 5,975,528 | A | | 11/1999 | Halaby | 273/148 |
| 5,976,016 | A | | 11/1999 | Moody et al. | 463/13 |
| 6,003,013 | A | | 12/1999 | Boushy et al. | 705/10 |
| 6,007,066 | A | | 12/1999 | Moody | 273/292 |
| 6,007,427 | A | | 12/1999 | Wiener et al. | 463/17 |
| 6,012,720 | A | | 1/2000 | Webb | 273/292 |
| 6,012,982 | A | | 1/2000 | Piechowiak et al. | 463/16 |
| 6,020,884 | A | | 2/2000 | MacNaughton et al. | 345/329 |
| 6,032,955 | A | | 3/2000 | Luciano et al. | 273/138.1 |
| 6,039,648 | A | | 3/2000 | Guinn et al. | 463/16 |
| 6,045,129 | A | | 4/2000 | Cooper et al. | 273/292 |
| 6,047,963 | A | | 4/2000 | Pierce et al. | 273/121 B |
| 6,077,162 | A | | 6/2000 | Weiss | 463/26 |
| 6,077,163 | A | | 6/2000 | Walker et al. | |
| 6,089,976 | A | | 7/2000 | Schneider et al. | 463/16 |
| 6,089,977 | A | | 7/2000 | Bennett | 463/20 |
| 6,089,980 | A | | 7/2000 | Gauselmann | 463/27 |
| 6,098,985 | A | | 8/2000 | Moody | 273/292 |
| 6,102,474 | A | | 8/2000 | Daley | 296/836 |
| 6,102,798 | A | | 8/2000 | Bennett | 463/16 |
| 6,102,799 | A | | 8/2000 | Stupak | 463/27 |
| 6,110,040 | A | | 8/2000 | Sanduski et al. | 463/13 |
| 6,110,043 | A | | 8/2000 | Olsen | 463/27 |
| 6,120,378 | A | | 9/2000 | Moody et al. | 463/20 |
| 6,132,311 | A | | 10/2000 | Williams | 463/13 |
| 6,139,013 | A | | 10/2000 | Pierce et al. | 273/121 B |
| 6,142,872 | A | | 11/2000 | Walker et al. | 463/16 |
| 6,146,273 | A | * | 11/2000 | Olsen | 463/27 |
| 6,149,521 | A | | 11/2000 | Sanduski | 463/13 |
| 6,155,925 | A | | 12/2000 | Giobbi et al. | 463/20 |
| 6,158,741 | A | | 12/2000 | Koelling | 273/292 |
| 6,159,097 | A | | 12/2000 | Gura | 463/20 |
| 6,165,071 | A | | 12/2000 | Weiss | |
| 6,168,155 | B1 | | 1/2001 | Kuhlman et al. | 273/144 |
| 6,168,523 | B1 | | 1/2001 | Piechowiak et al. | 463/26 |
| 6,203,010 | B1 | | 3/2001 | Jorasch et al. | 273/138.1 |
| 6,203,429 | B1 | | 3/2001 | Demar et al. | 463/20 |
| 6,206,374 | B1 | | 3/2001 | Jones | 463/26 |
| 6,206,780 | B1 | | 3/2001 | Awada | 463/13 |
| 6,206,782 | B1 | | 3/2001 | Walker et al. | 463/25 |
| 6,210,275 | B1 | | 4/2001 | Olsen | 463/16 |
| 6,210,277 | B1 | | 4/2001 | Stefan | 463/27 |
| 6,217,448 | B1 | | 4/2001 | Olsen | 463/25 |
| 6,220,593 | B1 | | 4/2001 | Pierce et al. | 273/138.1 |
| 6,224,482 | B1 | | 5/2001 | Bennett | 463/20 |
| 6,224,484 | B1 | | 5/2001 | Okuda et al. | 463/27 |
| 6,231,445 | B1 | | 5/2001 | Acres | 463/27 |
| 6,241,608 | B1 | | 6/2001 | Torango | 463/27 |
| 6,244,958 | B1 | | 6/2001 | Acres | |
| 6,248,016 | B1 | | 6/2001 | Walker et al. | 463/13 |
| 6,254,483 | B1 | | 7/2001 | Acres | 463/26 |
| 6,257,979 | B1 | | 7/2001 | Walker et al. | 463/13 |
| 6,299,533 | B1 | | 10/2001 | Parra et al. | 463/17 |
| 6,312,332 | B1 | | 11/2001 | Walker et al. | 463/23 |
| 6,315,660 | B1 | | 11/2001 | DeMar et al. | 463/16 |
| 6,319,125 | B1 | | 11/2001 | Acres | 463/25 |
| 6,319,127 | B1 | | 11/2001 | Walker et al. | 463/26 |
| 6,336,857 | B1 | | 1/2002 | McBride | 463/12 |
| 6,336,859 | B2 | | 1/2002 | Jones et al. | 463/42 |
| 6,336,860 | B1 | | 1/2002 | Webb | 463/22 |
| 6,336,862 | B1 | | 1/2002 | Byrne | 463/27 |
| 6,345,824 | B1 | | 2/2002 | Selitzky | 273/292 |
| 6,347,996 | B1 | | 2/2002 | Gilmore et al. | 463/17 |
| 6,352,479 | B1 | | 3/2002 | Sparks, II | 463/42 |
| 6,358,149 | B1 | | 3/2002 | Schneider et al. | 463/27 |
| 6,361,441 | B1 | | 3/2002 | Walker et al. | 463/42 |
| 6,364,765 | B1 | | 4/2002 | Walker et al. | |
| 6,364,768 | B1 | | 4/2002 | Acres et al. | 463/25 |
| 6,371,852 | B1 | | 4/2002 | Acres | |
| 6,375,567 | B1 | | 4/2002 | Acres | 463/25 |
| 6,375,568 | B1 | | 4/2002 | Roffman et al. | 463/26 |
| 6,406,369 | B1 | | 6/2002 | Baerlocher et al. | 463/20 |
| 6,416,407 | B1 | | 7/2002 | Carrico et al. | 463/13 |
| 6,416,408 | B2 | | 7/2002 | Tracy et al. | 463/29 |
| 6,416,409 | B1 | | 7/2002 | Jordan | 463/27 |
| 6,422,940 | B1 | | 7/2002 | Walker et al. | 463/13 |
| 6,431,983 | B2 | | 8/2002 | Acres | 463/25 |
| 6,435,968 | B1 | | 8/2002 | Torango | 463/27 |
| 6,439,995 | B1 | | 8/2002 | Hughs-Baird et al. | 463/20 |
| 6,461,240 | B1 | | 10/2002 | Perkins | 463/13 |
| 6,471,587 | B1 | | 10/2002 | Wood et al. | 463/13 |
| 6,474,645 | B2 | | 11/2002 | Tarantino | 273/274 |
| 6,482,089 | B2 | | 11/2002 | DeMar et al. | 463/20 |
| 6,494,454 | B2 | | 12/2002 | Adams | 273/292 |
| 6,506,117 | B2 | | 1/2003 | DeMar et al. | 463/20 |
| 6,507,709 | B2 | | 1/2003 | Hirai et al. | 463/42 |
| 6,508,707 | B2 | | 1/2003 | DeMar et al. | 463/16 |
| 6,517,433 | B2 | | 2/2003 | Loose et al. | 463/20 |
| 6,520,855 | B2 | | 2/2003 | DeMar et al. | 463/20 |
| 6,561,898 | B2 | | 5/2003 | Moody | 463/13 |
| 6,569,013 | B1 | | 5/2003 | Taylor | 463/13 |
| 6,569,014 | B2 | | 5/2003 | Walker et al. | 463/13 |
| 6,577,733 | B1 | | 6/2003 | Charrin | 380/251 |
| 6,589,115 | B2 | | 7/2003 | Walker et al. | 463/25 |
| 6,592,458 | B1 | | 7/2003 | Ho | 463/17 |
| 6,592,460 | B2 | | 7/2003 | Torango | 463/27 |
| 6,595,520 | B1 | | 7/2003 | Richards et al. | 273/292 |

(56) References Cited

U.S. PATENT DOCUMENTS 6,595,852 B2 7/2003 Wang ..... 463/13
6,599,186 B1 7/2003 Walker et al. ..... 463/17
6,599,188 B2 7/2003 Hirsch et al. ..... 463/19
6,599,193 B2 7/2003 Baerlocher et al. ..... 463/27
6,601,771 B2 8/2003 Charrin ..... 235/492
6,609,673 B1 8/2003 Johnson ..... 242/423
6,612,926 B1 9/2003 Dabrowski ..... 463/13
6,612,927 B1 9/2003 Slomiany et al. ..... 463/16
6,616,142 B2 9/2003 Adams ..... 273/292
6,637,747 B1 10/2003 Garrod ..... 273/292
6,648,753 B1 11/2003 Tracy et al. ..... 463/16
6,648,762 B2 11/2003 Walker et al. ..... 463/25
6,656,052 B2 12/2003 Abramopoulos et al. ..... 463/47
6,672,958 B2 1/2004 Bennett ..... 463/13
6,676,513 B2 1/2004 Gauselmann ..... 463/20
6,685,560 B1 2/2004 Hughes ..... 463/16
6,692,354 B2 2/2004 Tracy et al. ..... 463/30
6,708,975 B1 3/2004 Fox et al. ..... 273/292
6,712,695 B2 3/2004 Mothwurf et al. ..... 463/25
6,712,699 B2 3/2004 Walker et al. ..... 463/42
6,726,427 B2 4/2004 Jarvis et al. ..... 413/12
6,733,390 B2 5/2004 Walker et al. ..... 463/23
6,758,757 B2 7/2004 Luciano, Jr. et al.
6,776,715 B2 8/2004 Price ..... 463/27
6,780,106 B2 8/2004 DeMar et al. ..... 463/16
6,780,111 B2 8/2004 Cannon et al.
6,790,141 B2 9/2004 Muir ..... 463/42
6,800,027 B2 10/2004 Giobbi et al.
6,811,486 B1 11/2004 Luciano, Jr.
6,837,793 B2 1/2005 McClintic ..... 463/42
6,857,957 B2 2/2005 Marks et al. ..... 463/13
6,869,361 B2 3/2005 Sharpless ..... 463/25
6,887,154 B1 5/2005 Luciano, Jr. et al. ..... 463/26
6,887,159 B2 5/2005 Leen et al. ..... 463/42
6,923,721 B2 8/2005 Luciano et al.
6,960,134 B2 11/2005 Hartl et al.
7,004,466 B2 2/2006 Gauselmann ..... 463/138
7,036,012 B2 4/2006 Charrin ..... 213/169
7,048,628 B2 * 5/2006 Schneider ..... 463/16
7,056,215 B1 6/2006 Olive ..... 463/27
7,063,617 B2 6/2006 Brosnan et al.
7,291,068 B2 11/2007 Bryant et al.
7,780,531 B2 * 8/2010 Englman et al. ..... 463/42
2002/0034974 A1 3/2002 Wood et al. ..... 463/13
2002/0077174 A1 6/2002 Luciano et al.
2002/0138594 A1 9/2002 Rowe ..... 709/219
2002/0151345 A1 10/2002 Byrne ..... 463/18
2002/0151354 A1 * 10/2002 Boesen et al. ..... 463/25
2002/0155874 A1 10/2002 Byrne ..... 463/16
2002/0169015 A1 11/2002 Moody ..... 463/13
2002/0185816 A1 12/2002 Moody et al. ..... 273/292
2003/0011127 A1 * 1/2003 Vancura et al. ..... 273/236
2003/0014370 A1 1/2003 Charrin ..... 17/60
2003/0027618 A1 2/2003 Byrne ..... 463/16
2003/0027625 A1 2/2003 Rowe ..... 463/20
2003/0032469 A1 2/2003 Moody et al. ..... 463/13
2003/0036430 A1 2/2003 Cannon ..... 463/42
2003/0038425 A1 2/2003 Tarantino ..... 273/274
2003/0040352 A1 * 2/2003 Marks et al. ..... 463/13
2003/0045337 A1 3/2003 Byrne ..... 463/16
2003/0047874 A1 3/2003 Leen et al. ..... 273/292
2003/0060106 A1 3/2003 Haggquist et al. ..... 442/131
2003/0060266 A1 3/2003 Baerlocher ..... 463/20
2003/0064773 A1 4/2003 Baerlocher et al. ..... 463/16
2003/0064776 A1 4/2003 Byrne ..... 463/16
2003/0064807 A1 4/2003 Walker ..... 463/42
2003/0109306 A1 6/2003 Karmarkar ..... 463/40
2003/0114218 A1 6/2003 McClintic ..... 463/25
2003/0119572 A1 6/2003 Moody et al. ..... 463/13
2003/0119576 A1 6/2003 McClintic ..... 463/20
2003/0148808 A1 8/2003 Price ..... 463/27
2003/0153377 A1 8/2003 Lisowski, Sr. ..... 463/13
2003/0166411 A1 9/2003 Moody ..... 463/13
2003/0181231 A1 9/2003 Vancura et al. ..... 463/9
2003/0181232 A1 9/2003 Peccole, Jr. ..... 463/13
2003/0186733 A1 10/2003 Wolf et al. ..... 463/16
2003/0189290 A1 10/2003 Moody ..... 273/292
2003/0211884 A1 11/2003 Gauselmann ..... 463/20
2003/0214097 A1 11/2003 Moody ..... 273/292
2003/0216166 A1 11/2003 Baerlocher et al. ..... 463/20
2003/0222402 A1 12/2003 Olive ..... 273/292
2003/0224852 A1 12/2003 Walker ..... 463/20
2003/0228899 A1 12/2003 Evans ..... 463/25
2003/0236116 A1 12/2003 Marks et al. ..... 463/16
2004/0009808 A1 1/2004 Gauselmann ..... 463/25
2004/0009811 A1 1/2004 Torango ..... 463/25
2004/0023716 A1 2/2004 Gauselmann ..... 463/23
2004/0038735 A1 * 2/2004 Steil et al. ..... 463/27
2004/0038741 A1 2/2004 Gauselmann ..... 463/42
2004/0043807 A1 3/2004 Pennington ..... 463/13
2004/0048644 A1 3/2004 Gerrard et al. ..... 463/16
2004/0087368 A1 5/2004 Gauselmann ..... 463/42
2004/0092304 A1 5/2004 George ..... 463/29
2004/0102243 A1 * 5/2004 Olsen ..... 463/25
2004/0106448 A1 6/2004 Gauselmann ..... 463/25
2004/0132524 A1 7/2004 Ramstad et al. ..... 463/16
2004/0142742 A1 7/2004 Schneider et al.
2004/0152511 A1 * 8/2004 Nicely et al. ..... 463/27
2004/0204226 A1 10/2004 Foster et al. ..... 463/20
2004/0204235 A1 10/2004 Walker et al. ..... 463/29
2004/0235552 A1 11/2004 Gauselmann ..... 463/16
2004/0242297 A1 12/2004 Walker et al. ..... 463/16
2004/0242303 A1 12/2004 Walker et al. ..... 463/16
2004/0248641 A1 12/2004 Jarvis et al. ..... 463/20
2004/0248651 A1 12/2004 Gagner ..... 463/42
2005/0003880 A1 1/2005 Englman ..... 463/16
2005/0003886 A1 1/2005 Englman et al. ..... 463/25
2005/0014554 A1 1/2005 Walker et al. ..... 463/20
2005/0026674 A1 2/2005 Wolf et al. ..... 463/19
2005/0055113 A1 3/2005 Gauselmann ..... 700/91
2005/0059467 A1 3/2005 Saffari et al. ..... 463/19
2005/0059472 A1 3/2005 Joshi et al. ..... 463/20
2005/0064930 A1 3/2005 Jubinville et al. ..... 463/17
2005/0096130 A1 5/2005 Mullins ..... 463/27
2005/0119043 A1 6/2005 Berman et al.
2005/0137010 A1 6/2005 Enzminger et al. ..... 463/25
2005/0148382 A1 7/2005 Fox ..... 463/19
2005/0159207 A1 7/2005 Thomas
2005/0187008 A1 8/2005 Nakajima ..... 463/16
2005/0187014 A1 * 8/2005 Saffari et al. ..... 463/27
2005/0192073 A1 9/2005 Nakajima ..... 463/27
2005/0192088 A1 9/2005 Hartman et al. ..... 463/27
2005/0215313 A1 * 9/2005 O'Halloran ..... 463/26
2005/0215314 A1 * 9/2005 Schneider et al. ..... 463/26
2005/0282628 A1 12/2005 Beatty ..... 463/27
2006/0003829 A1 1/2006 Thomas ..... 463/20
2006/0009283 A1 1/2006 Englman et al. ..... 463/16
2006/0019737 A1 1/2006 Yang ..... 463/19
2006/0025195 A1 2/2006 Pennington et al. ..... 463/16
2006/0025210 A1 2/2006 Johnson ..... 463/25
2006/0030403 A1 2/2006 Lafky et al. ..... 463/27
2006/0052159 A1 3/2006 Cahill et al. ..... 463/27
2006/0068875 A1 3/2006 Cregan et al.
2006/0068893 A1 3/2006 Jaffe et al.
2006/0073877 A1 4/2006 Rodgers et al. ..... 463/20
2006/0073889 A1 4/2006 Edidin et al. ..... 463/27
2006/0079316 A1 4/2006 Flemming et al.
2006/0079317 A1 4/2006 Flemming et al.
2006/0084495 A1 4/2006 Jaffe et al.
2006/0089194 A1 4/2006 Joshi et al.
2006/0116201 A1 6/2006 Gauselmann ..... 463/26
2006/0142079 A1 6/2006 Ikehara et al. ..... 463/27
2006/0142086 A1 6/2006 Blackburn et al. ..... 463/42
2006/0154718 A1 7/2006 Willyard et al. ..... 463/25
2006/0178203 A1 8/2006 Hughes et al. ..... 463/20
2006/0183535 A1 8/2006 Marks et al. ..... 463/20
2006/0183537 A1 8/2006 Dickerson ..... 463/27
2006/0183538 A1 8/2006 Michaelson et al. ..... 463/27
2006/0281527 A1 12/2006 Dunaevsky et al. ..... 463/20
2006/0287077 A1 12/2006 Grav et al. ..... 463/27
2007/0026941 A1 2/2007 Block et al. ..... 463/29
2007/0054733 A1 3/2007 Baerlocher ..... 463/27
2007/0060244 A1 3/2007 Yaldoo et al. ..... 463/16
2007/0060271 A1 3/2007 Cregan et al. ..... 463/16

(56) References Cited

U.S. PATENT DOCUMENTS

| | | | | |
|---|---|---|---|---|
| 2007/0060314 | A1 | 3/2007 | Baerlocher et al. | 463/25 |
| 2007/0060319 | A1 | 3/2007 | Block et al. | 463/27 |
| 2007/0060365 | A1 | 3/2007 | Tien et al. | 463/42 |
| 2007/0167210 | A1 * | 7/2007 | Kelly et al. | 463/16 |
| 2010/0087256 | A1 * | 4/2010 | Frattinger et al. | 463/42 |

FOREIGN PATENT DOCUMENTS

| | | | | |
|---|---|---|---|---|
| DE | 196 24 321 | A1 | 1/1998 | G07F 17/32 |
| EP | 0 521 599 | A1 | 1/1993 | G07F 17/34 |
| GB | 2 153 572 | A | 8/1985 | G07F 17/34 |
| GB | 2 181 589 | A | 4/1987 | G07F 17/34 |
| GB | 2 242 300 | A | 9/1991 | G07F 17/34 |
| GB | 2 313 792 | A | 12/1997 | |
| GB | 2 333 880 | | 8/1999 | G07F 17/34 |
| WO | WO 97/27570 | | 7/1997 | G07F 17/34 |
| WO | WO 99/03078 | A1 | 1/1999 | G07F 17/34 |
| WO | WO 99/19037 | A1 | 4/1999 | A63F 9/22 |
| WO | WO 01/33478 | A1 | 5/2001 | G07F 17/34 |
| WO | WO 03/26754 | A1 | 4/2003 | A63F 5/00 |
| WO | WO 03/083789 | A1 | 10/2003 | |
| WO | WO 2005/082480 | A1 | 9/2005 | |
| WO | WO 2006/002241 | A2 | 1/2006 | |
| WO | WO 2006/004831 | A2 | 1/2006 | |
| WO | WO 2006/004832 | A2 | 1/2006 | |
| WO | WO 2006/005073 | A2 | 1/2006 | |
| WO | WO 2006/017036 | A1 | 2/2006 | |
| WO | WO 2006/017067 | A1 | 2/2006 | |
| WO | WO 2006/017068 | A1 | 2/2006 | |
| WO | WO 2006/020811 | A2 | 2/2006 | |
| WO | WO 2006/026250 | A2 | 3/2006 | |
| WO | WO 2006/044252 | A2 | 4/2006 | |

OTHER PUBLICATIONS

Article for "Millioniser" by Glenn Haussman, Strictly Slots, pp. 50-53 (Mar. 2004).

Product Sheet for "Big Games Safari," IGT, 24 pages (2000).

"New '97 Games," International Gaming & Wagering Business, 24 pages (Mar. 1997).

Search Report corresponding to International Patent Application Serial No. PCT/US2008/082222, United States Patent Office; dated Mar. 2, 2009; 3 pages.

Written Opinion corresponding to International Patent Application Serial No. PCT/US2008/082222, United States Patent Office; dated Mar. 2, 2009; 10 pages.

International Preliminary Report on Patentability corresponding to International Patent Application Serial No. PCT/US2008/082222, United States Patent Office; dated Feb. 3, 2010; 4 pages.

* cited by examiner

NEW SHEET

WAGERING GAME WITH COMMUNITY EVENT POKER GAME

CROSS REFERENCE TO RELATED APPLICATIONS

This application is a U.S. national stage filing of International Application No. PCT/2008/082222, filed Nov. 3, 2008 claiming priority from U.S. Provisional Application No. 61/002,350, filed Nov. 8, 2007, and U.S. Provisional Application No. 61/124,693, filed Apr. 18, 2008, and U.S. Provisional Application No. 61/188,126, filed Aug. 6, 2008, and U.S. Provisional Application No. 61/108,970, filed Oct. 28, 2008, which are all incorporated herein by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming machine and a gaming system having a community event provided with a plurality of communal features.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

SUMMARY OF THE INVENTION

According to one aspect of the present invention, a gaming system for conducting a wagering game includes a display for displaying a base game of the wagering game in response to receiving a wager input from a player and a controller coupled to the display. The controller is programmed to randomly increment during game play a bonus-time eligibility counter for a community bonus game, decrement the bonus-time eligibility counter as real time progresses, and render a player eligible to play the community bonus game if the bonus-time eligibility counter is greater than zero when a community bonus game is triggered.

According to another aspect of the invention, a method of conducting a wagering game on a gaming system comprises conducting a first base wagering game having a first EV at a first gaming machine in response to receiving a wager input from a player and randomly incrementing, during game play of the first base wagering game, a community event bonus-time eligibility counter for a community event bonus game, a community event bonus multiplier, or both a bonus-time eligibility counter for the community event bonus game and the community event bonus multiplier. The method also includes decrementing the first gaming machine eligible bonus-time eligibility counter in real time and rendering a player at the first gaming machine eligible to play the community event bonus game if the bonus-time eligibility counter of the first gaming machine is greater than zero when a community event bonus game is triggered.

According to another aspect of the invention, a method of conducting a wagering game on a gaming system comprises conducting a community event bonus game and awarding one or more awards to each eligible player. In this method, the act of awarding one or more awards comprises awarding, a first value of awards to players who obtained eligibility for the community event bonus game on a first base wagering game having a first EV and awarding a second value of awards to players who obtained eligibility for the community event bonus game on a second base wagering game having a second EV lower than the first EV. The first value of awards is statistically lower than the second value of awards.

According to another aspect of the invention, a method of conducting a wagering game on a gaming system comprises conducting a community event bonus game and awarding one or more awards to each eligible player. In this method, the act of awarding one or more awards to each eligible player comprises discriminating between players of base wagering games having different EVs, applying a first community event bonus EV to players of base wagering games having a first EV, and applying a second community event bonus EV to players of base wagering games having a second EV. In this method, the first community event bonus EV is lower than the second community event bonus EV, the first EV is higher than the second EV, and the sum of the EVs of the first community event bonus EV and the first EV is at least substantially the same as the sum of the EVs of the second community event bonus EV and the second EV.

According to yet another aspect of the invention, a computer readable storage medium is encoded with instructions for directing a gaming system to perform the above method.

According to yet another aspect of the invention, a gaming system for playing a wagering game, comprises a gaming machine comprising a display, the gaming machine being configured to display an outcome of a wagering game conducted on the gaming machine in response to a wager input from a player, the outcome of the wagering game comprising the display of an array of randomly determined symbols and a controller coupled to the display. The controller is programmed to increment a bonus-time eligibility counter for a community bonus game responsive to the wager input, increment during game play at least one of a bonus-time eligibility counter for a community bonus game or a benefit associated with the community bonus game responsive to an occurrence of a community bonus game symbol in the array of randomly determined symbols, decrement the bonus-time eligibility counter as real time progresses, render a player eligible to play the community bonus game if the bonus-time eligibility counter is greater than zero when a community bonus game is triggered, and modify any award realized during the community bonus game by any benefit associated with the community bonus game realized during the wagering game.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
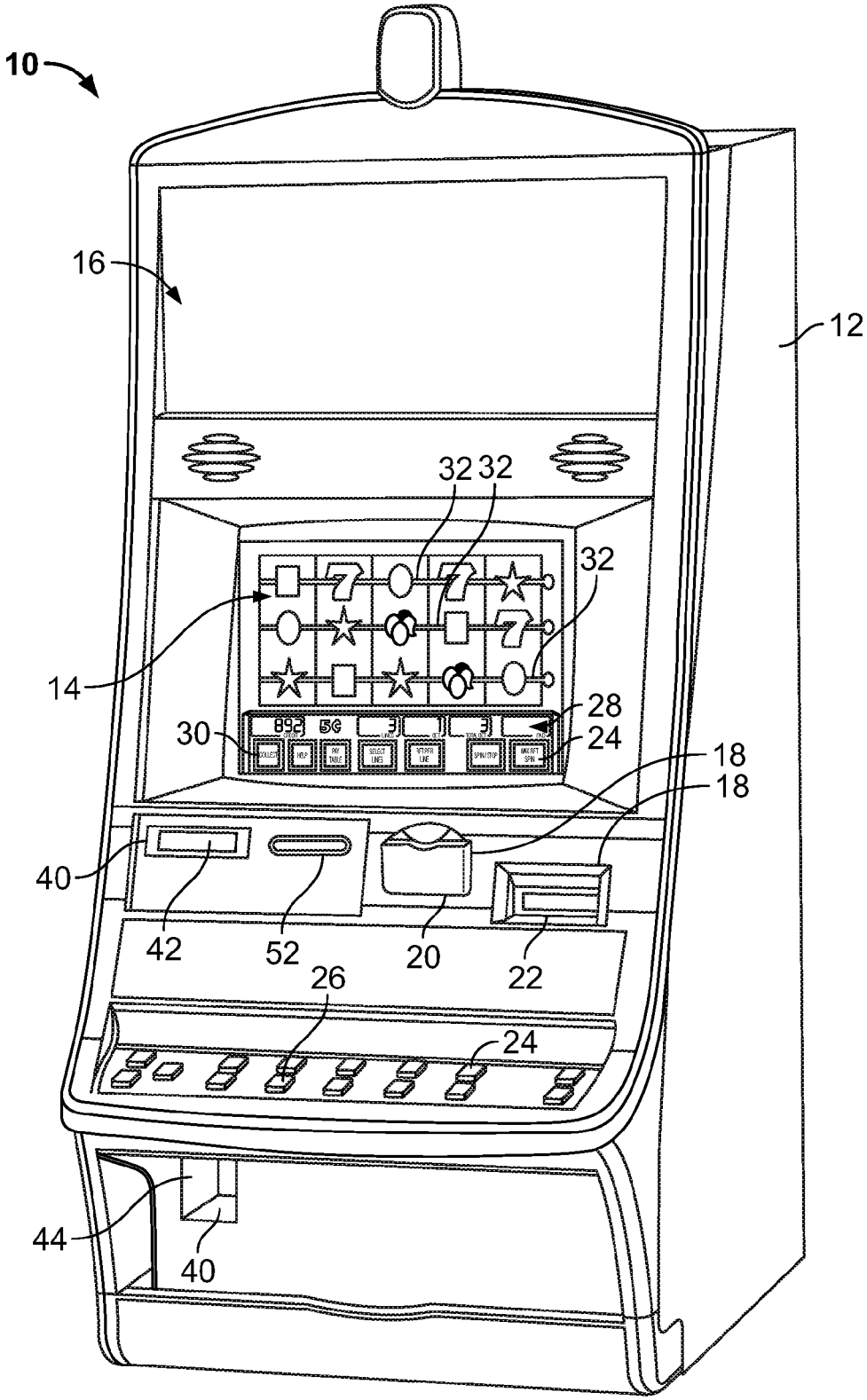
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, a light emitting diode (LED) display, a DLP projection display, an electroluminescent (EL) panel, or any other type of display suitable for use in the gaming machine 10.

As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
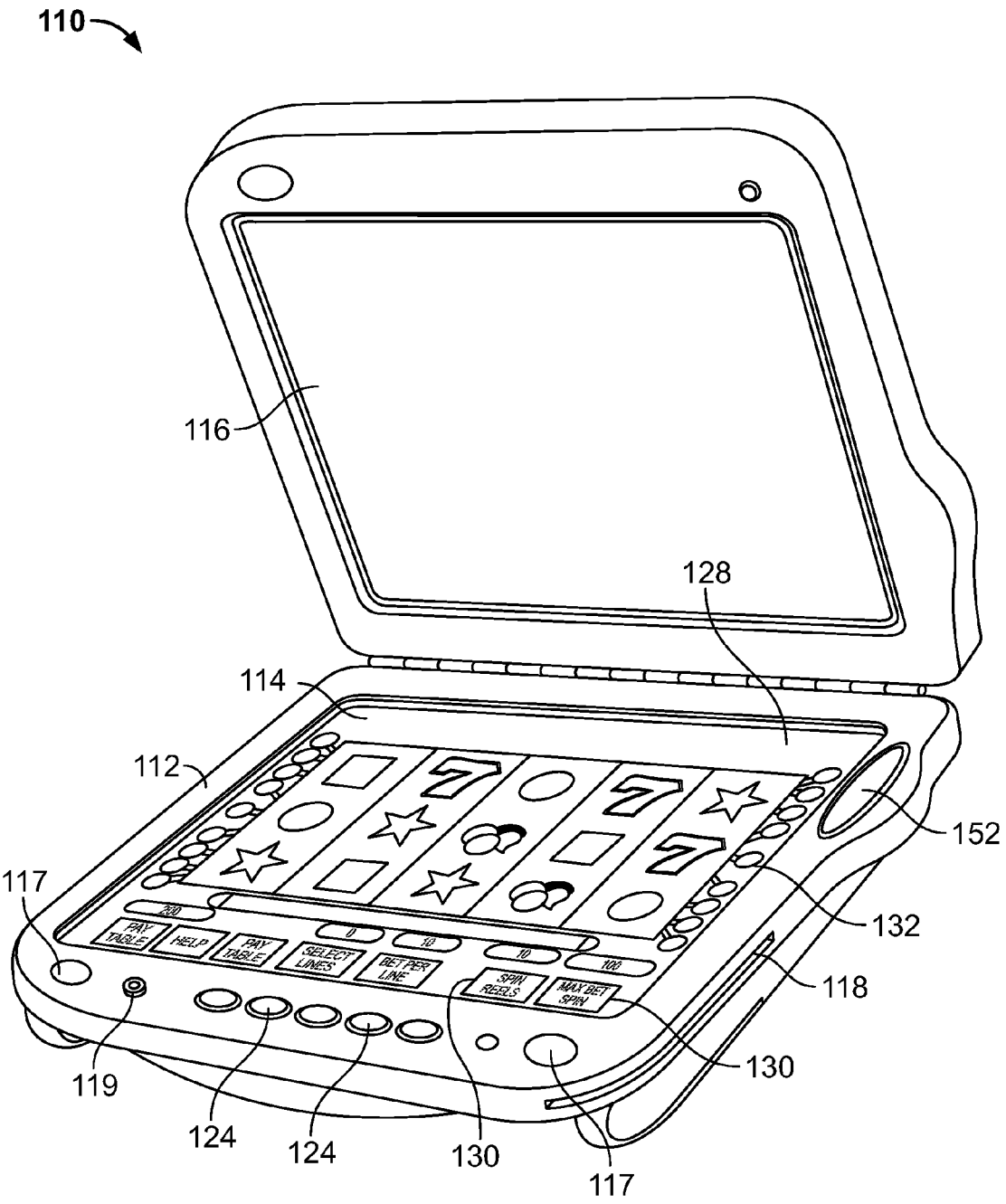
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
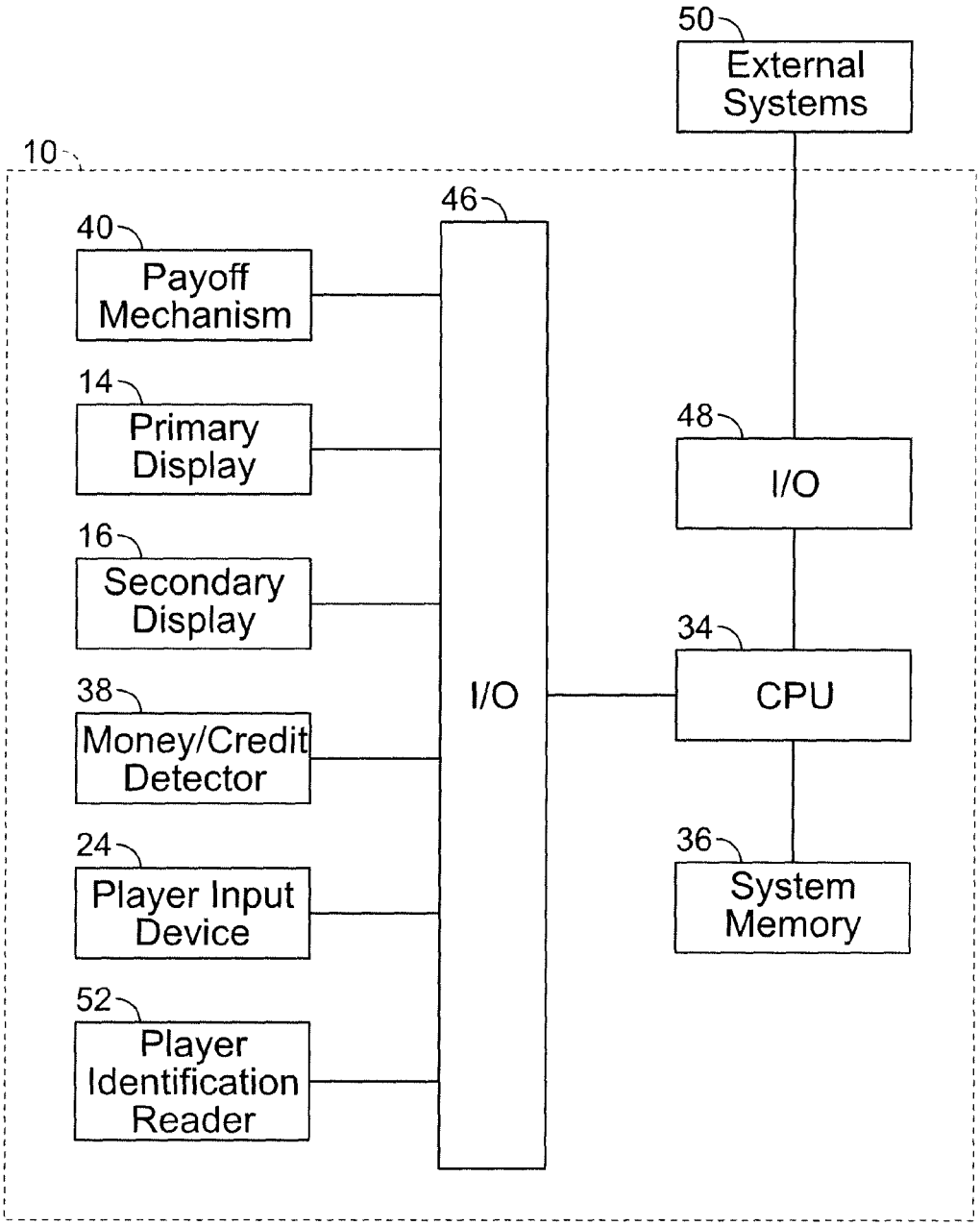
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10 bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality therebetween (e.g., a "rich client"). As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "rich client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Security features are advantageously utilized where the gaming machines 10,110 communicate wirelessly with external systems 50, such as through wireless local area network (WLAN) technologies, wireless personal area networks (WPAN) technologies, wireless metropolitan area network (WMAN) technologies, wireless wide area network (WWAN) technologies, or other wireless network technologies implemented in accord with related standards or protocols (e.g., the Institute of Electrical and Electronics Engineers (IEEE) 802.11 family of WLAN standards, IEEE 802.11i, IEEE 802.11r (under development), IEEE 802.11w (under development), IEEE 802.15.1 (Bluetooth), IEEE 802.12.3, etc.). For example, a WLAN in accord with at least some aspects of the present concepts comprises a robust security network (RSN), a wireless security network that allows the creation of robust security network associations (RSNA) using one or more cryptographic techniques, which provides one system to avoid security vulnerabilities associated with IEEE 802.11 (the Wired Equivalent Privacy (WEP) protocol). Constituent components of the RSN may comprise, for example, stations (STA) (e.g., wireless endpoint devices such as laptops, wireless handheld devices, cellular phones, handheld gaming machine 110, etc.), access points (AP) (e.g., a network device or devices that allow(s) an STA to communicate wirelessly and to connect to a(nother) network, such as a communication device associated with I/O circuit(s) 48), and authentication servers (AS) (e.g., an external system 50), which provide authentication services to STAs. Information regarding security features for wireless networks may be found, for example, in the National Institute of Standards and Technology (NIST), Technology Administration U.S. Department of Commerce, Special Publication (SP) 800-97, Establishing Wireless Robust Security Networks: A Guide to Ieee 802.11, and SP 800-48, Wireless Network Security: 802.11, Bluetooth and Handheld Devices, both of which are incorporated herein by reference in their entirety.

Figure 3A:
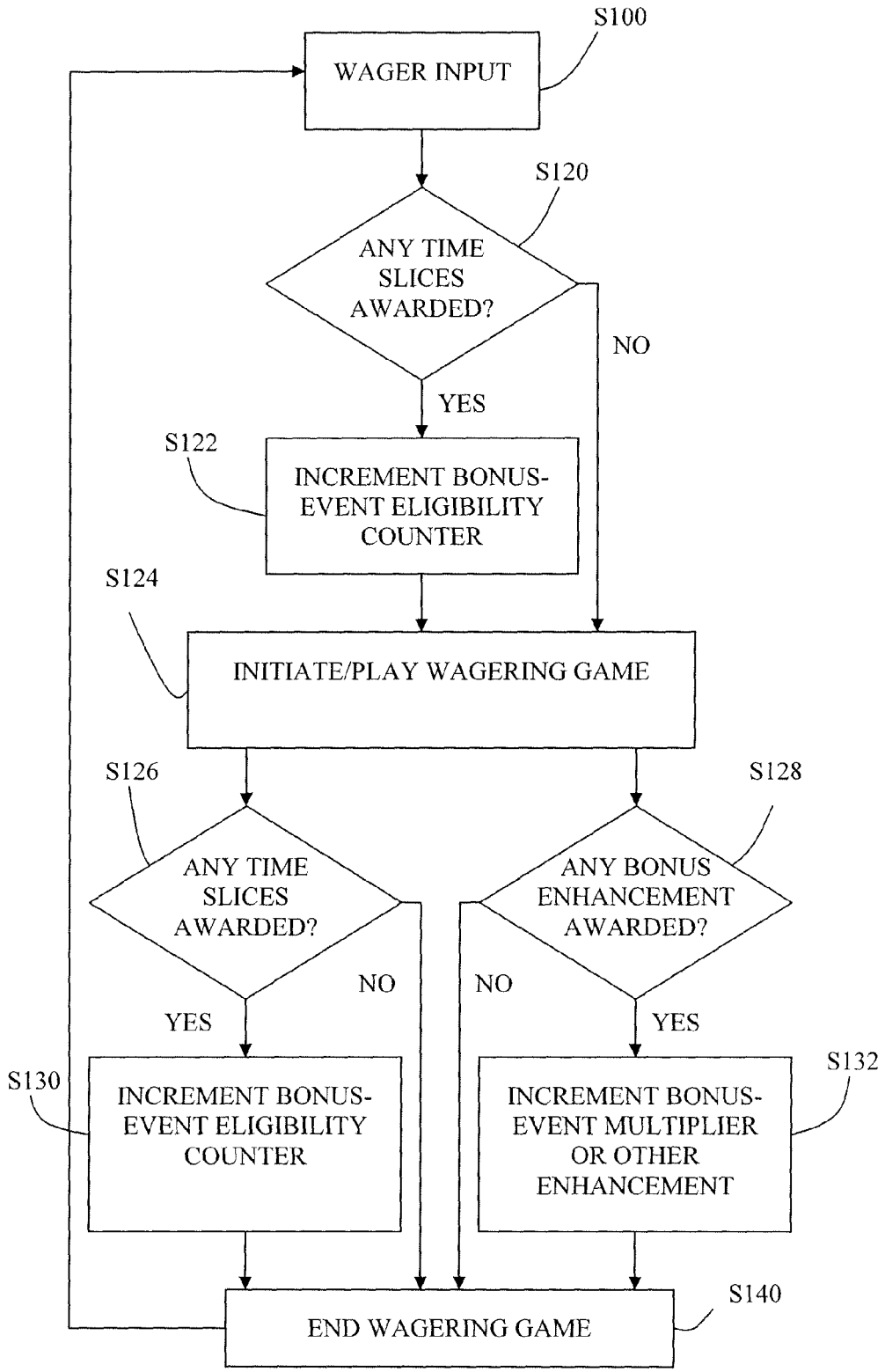
FIG. 3*a* is a flow chart representing a foreground process of game play in accord with at least some aspects of the present concepts.
Figure 3B:
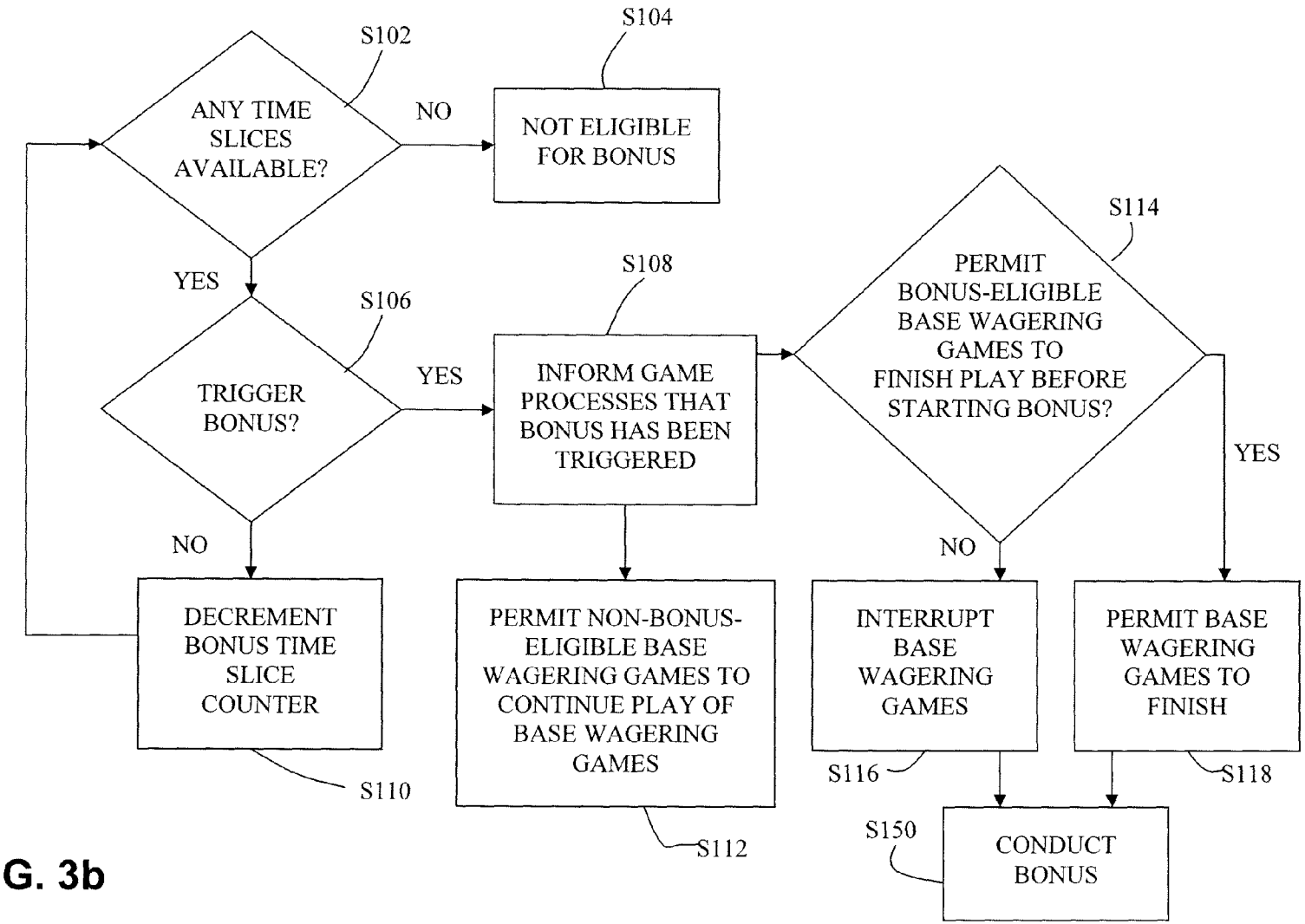
FIG. 3*b* is a flow chart representing a background process of determining bonus-time eligibility for a gaming machine, according to one embodiment of the present invention.

Turning now to FIGS. 3*a*-3*b*, these flow charts illustrate one, non-limiting method for determining an eligibility of a player to participate in a community event (e.g., Big Event Poker, shown in FIGS. 4-10) based on time eligibility of a player. Generally, FIG. 3*a* is a flow chart representing one example of a foreground process of game play, readily observable to a player, and FIG. 3*b* is a flow chart representing one example of a background process of determining bonus-time eligibility for a gaming machine, each according to at least one embodiment of the present concepts.

Time-based eligibility for a community event bonus is measured using a "time slice," which may be one second, a fraction of a second, or more than one second (e.g., 30 seconds, 45 seconds, one minute, 5 minutes, 10 minutes, etc.).

Figure 4:
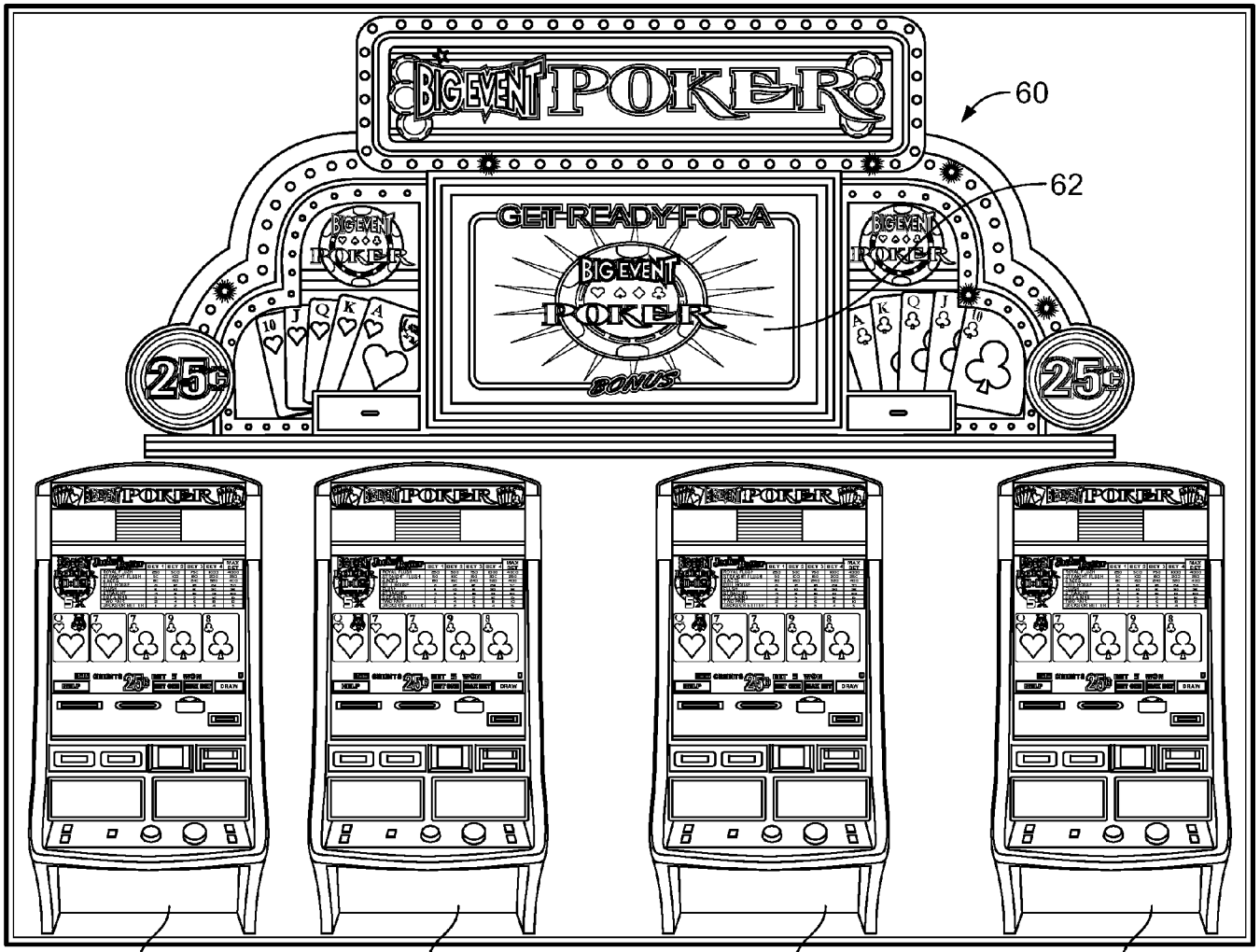
FIG. 4 depicts an example of a community gaming system comprising interconnected wagering gaming machines and signage according to at least one embodiment of the present concepts.

At act S100 in FIG. 3*a*, an initial wager input is received from the player as the player begins play at a gaming machine (see, e.g., 10*a* in FIG. 4). In at least some aspects of the present concepts, the initial wager itself, as well as each subsequent wager, may grant the player a predetermined number of time slices, which are preferably displayed to the player on the gaming machine primary display and/or secondary display (see, e.g., 14, 16 in FIG. 1*a*) and/or signage 60, shown in FIG. 4. The predetermined number of time slices may correspond to an amount of the wager, or may be granted only subject to satisfaction of a minimum wager amount. So obtained, the predetermined number of time slices are allocated to a player's community event bonus eligibility time counter, as shown in act S120.

One or more time slices may also be obtained in act S126 following the initiation of a base wagering game and/or during play of the base wagering game in act S124 in the flowchart of FIG. 3*a*. Examples of situations where time slices may be obtained during play of the base wagering game include, but are not limited to, an award of time slices during game play for achieving one or more predetermined outcomes (e.g., a dealing of one or more particular cards to a player wherein a predetermined number of cards or a random number of cards in the deck dealt to the player are randomly associated with a predetermined number of time slices or a random number of time slices), and/or a random award of time slices that is independent of any predetermined outcome or player input (e.g., randomly granted time slices during game play). In still other aspects, time slices may be obtained by game play itself. For example, a predetermined number of time slices are granted upon each deal of a hand in poker, such number being either wager independent (i.e., all players receive an equal number of time slices per play) or wager dependent (i.e., players with higher wagers receive a correspondingly higher number of time slices per play).

The predetermined number of time slices being granted, such as in act S126 of FIG. 3*a*, may optionally vary in accord with variables such as, but not limited to, participation in a Player's Club, historical variables, an amount wagered in a base wagering game, or the like. Thus, a high roller placing maximum wagers might be awarded a multiple of a number of time slices provided to another player that is placing minimum wagers or might be awarded an additional time slice or a plurality of time slices provided to another player that is placing minimum wagers.

In still another aspect, at any time before, during, or after base wagering game play, a player may be permitted to simply purchase one or more time slices. For example, a player may outright purchase a block of time slices and authorize an appropriate controller or service (e.g., "Big Event Coordinator) to automatically begin decrementing time slices from that block of time slices upon exhausting of all available time slices from the time slice counter. Alternatively, a player may pre-authorize prior to play or authorize during play (e.g., accepting a prompt from a pop-up window) automated purchase of time slices from a win meter amount at a rate sufficient to ensure continued eligibility for the bonus game or community game. In still other aspects, a player may open a line of credit or fund an account from which time credits may be automatically purchased on an as-needed basis to ensure continued eligibility of the player for a community event. Where a player sets up an account or accounts to handle automated maintenance of the players' time slice counter, whether using a casino account or a third-party account, the player may opt to select a minimum multiplier level that he or she wants to maintain. Deductions from or charges to such account(s) would then ensure sufficient purchase of time slice counters to maintain such minimum multiplier level until the authorization is terminated. To facilitate purchase of time slices during game play, a prominent (e.g., lighted, brightly colored, etc.) "Time Slice Quick Purchase!" button may optionally be integrated into the touch screen display or button panel 24 to permit a player to instantly purchase a predefined duration of community bonus event eligibility (e.g., a predefined plurality of time slices), so as to enable a player to quickly maintain eligibility when he or she sees that his or her eligibility time dwindling toward zero.

Turning to FIG. 3*b*, at act S102, a determination is made whether any time slices are available, i.e., whether the player is eligible for playing the bonus game or community event game. If the player does not have any time slices available, then, at act S104, it is determined that the player is not eligible for playing the bonus game or community event game. If the player has at least one time slice available, then, at act S106, a determination is made whether the bonus game or community event game should be triggered.

If the bonus game or community event game is triggered, then, at act S108, the game process is informed that the bonus game or community event game has occurred. Non-community-event-game-eligible players are then permitted to continue play of their base wagering games in act S112, whereas community-event-game-eligible players are permitted to progress to the community event game, either before (S116) or after (S118) completion of their base wagering games. In the community event game is not triggered in act S106, a time slice is decremented from the time-slice counter in act S110. Then, the process goes back to act S102 to determine whether there are any time slices available. In at least some aspects, this process continues regardless of any player's activity in the base wagering game. Thus, with respect to FIG. 3*a*, if a player has ended a wagering game at act S140 and has not yet initiated another wager input (act S100), the decrementing of the players community event time slice counter continues unabated and the player having eligibility time slices may yet qualify for a community bonus event even when not engaged in game play.

The time-slice counter represented in acts S122 and S130 of FIG. 3*a* and in act S110 in FIG. 3*b* is used to increment and/or decrement time slices for increasing and/or decreasing the time that the player is eligible to play the time-based bonus game, such as a bonus game or community event game. In the background, as represented in FIG. 3*b*, during each increment of time, an RNG determines whether the bonus game is triggered in act S106. If the player has eligibility during that increment of time, then all of the players of both eligible and non-eligible gaming machines 10, 110 are informed in act S108 of the triggering of the community event bonus game and eligible players are allowed to continue on to play the community event game(s). The eligible players may be optionally permitted, in acts S114 and S118, to finish play of their current base wagering games before starting the community event bonus game(s) in act S150. Alternatively, in act S116, the eligible players' base wagering games may be interrupted to play the community event bonus game(s) and, upon completion of the community event bonus game(s), the player will be returned to the same state of game play.

In at least some aspects of the present concepts, such as is represented by act S128 in which the game process or controller determines whether any bonus enhancement such as, but not limited to, a community event bonus multiplier, is to be awarded. The bonus enhancement does not relate to eligibility, but does apply to increase a player's award should they be eligible for and in fact play in the community event game in act S150. The amount of the bonus multiplier may comprise, in one embodiment, a function of the amount wagered with respect to time. For example, each credit buys 1 time slice of eligibility for the bonus game or community game. The price of each time slice may be varied, as desired (e.g., two credits per time slice, two time slices per credit, etc.). Two things occur at every time slice interval (i.e., every 250 ms, every second, etc.). First, a decision is made to determine if a time-based game should be triggered. Second, the number of time slices that the player has accumulated is updated (e.g., decremented).

The time-based bonus game or community game is triggered, in act S106, randomly, pseudo-randomly, or following satisfaction of one or more predetermined triggering conditions. In at least some aspects, the time-based bonus games or community games are triggered asynchronously from normal game flow. An asynchronous process executes the RNG to select a random number at some predefined time interval. This random number is then compared to a predefined number or series of predefined numbers. If the random number matches, or is a subset of the predefined series, a bonus game is triggered. If the random number does not match, or is not a subset of the predefined series, then no bonus game is triggered. The time interval of how often a number is selected, what range the number is selected from, and the criteria for matching to trigger a bonus are all dependent on the desired mathematics of the game.

In some aspects, the time slice interval is determined from variables including, but not limited to, an expected value (EV) of the base wagering game or the bonus game or community game and/or a probability of occurrence of the bonus game or community game. For example, if the time-based bonus game is to take up to 10% of the total return in the wagering game, then each time slice should have an Expected Value ("EV") of 0.1 credits where the time slices are purchased for 1 credit (i.e., 10% of 1 credit=0.1 credits). In addition, the EV of each time slice is the product of the chance of the bonus and the EV of the bonus or, stated differently, the chance of the bonus is equal to the dividend of the EV of the time slice by the EV of the bonus. Thus, for an EV of a time slice of 0.1 credits and an EV of the bonus as 2000 credits, a bonus would occur, on average, once every 20000 time slices. For 250 ms. time slices, for example, a bonus game would occur on average about every 5000 seconds or 83 minutes.

At every time slice interval, a process executes to remove one of the time slices. Optionally, more than one time slice can be removed when considering multipliers greater than 1×. The removal of the time slices continues until all of the player's time slices are removed. When all the time slices have been removed, the player becomes ineligible for playing the bonus game. Thus, where a player's bet or game play has yielded twenty 250 ms. time slices, the player has 5 seconds of bonus eligibility and a time slice is removed from this counter every 250 ms. until no more time slices remain.

The examples depicted in FIGS. 4-10 represent a poker-based base wagering game and a correspondingly-themed community event. When the player presses a play button (e.g., a deal button or max bet button) on the player input device 24, touch screen display, or touch screen panel, or the like, and, at least in accord with some aspects of the present concepts, a hand of cards 220 are dealt and one or more time slices added to the player's time slice counter. Optionally, no time slices are awarded upon the wagering and/or deal of the hand of cards 220 to the player. As noted above, the number of time slices added to the player's time slice counter may be, but is not required to be, proportional to a player's wager, with larger wagers commanding greater numbers of time slices than lesser wagers. Optionally, higher wagers, such as "Max Bet" may award proportionally more than a simple multiple of the wagered credits. For example, in a video poker game having time slices of 250 ms. and permitting wagers of one to five credits, a wager of one credit to four credits may respectively yield to the player 5, 10, 15, and 20 time slices, whereas a "Max Bet" may yield to the player 50 time slices (e.g., 25 seconds of eligibility for "Max Bet" in this example).

This above example of allocation of a predetermined number of time slices to an initial wager is non-limiting and, of course, the duration of the time slices and/or the number of time slices awarded for a given wager may also or alternatively be varied by game designers to suit game play. For example, the number time slices awarded might be weighted toward higher wagers, wherein a wager of 1 or 2 credits yields no time slices, a wager of 3 credits yields 5 time slices, a wager of 4 credits yields 25 time slices, and a wager of 5 credits yields 50 time slices. Still further, a player may only receive a predetermined number of time slices if they wager "Max Bet" and are only permitted to play the basic wagering game and any associated non-community event bonus game associated with the basic wagering game. In another variation, each additional extra credit wagered beyond the "Max Bet" may confer to the player, for a limited number of credits (e.g., up to 5 additional credits), a predetermined number of additional time slices proportional to the number of time slices awarded to the player for placing a "Max Bet" wager (e.g., 10 time slices per additional credit in the preceding example).

In one embodiment of at least some aspects of the present concepts, the player must make a "Max Bet" wager and make an additional 2 credit extra bet to obtain time slices and thereby obtain potential eligibility for a community bonus, such as the Big Event bonus, during the pendency of such time slices. The number of additional credits beyond the "Max Bet" needed to be wagered to obtain such potential for eligibility may be varied by game designers to suit game play. For example, the number of additional credits beyond the "Max Bet" needed to be wagered to obtain such potential for eligibility may be set to be one credit, three credits, or more than three credits.

For a given wager, a player satisfying or exceeding a minimum threshold wager to obtain potential eligibility for a community game, such as the Big Event bonus, may also optionally be given options, such as being able to choose whether they would like to receive a predetermined number of time slices, corresponding to the wager, at a lower multiplier (e.g., 1×) or a lesser number of time slices, corresponding to the wager, at a higher multiplier (e.g., 2× or 3×). Thus, a player may be permitted to choose between maximizing eligibility or maximizing potential awards in a bonus game or community event game should eligibility be conferred in the allotted time period.

Alternatively, multipliers, where provided, may be assigned only to progressively larger wagers. For example, in the above example wherein a player is required to make a "Max Bet" wager and place an additional 2 credit extra wager to obtain time slices and thereby obtain potential eligibility for a community bonus, such eligibility may be only at a "1×" multiplier. The player may be permitted to place a still additional x credit wager (e.g., 3 credits), above the 7 credits already wagered, to increase a Big Event multiplier to "2×" or to place a still larger y credit wager (e.g., 6 credits), above the 7 credits already wagered, to increase a Big Event multiplier to "3×".

In still other aspects, since poker-based games and card-based games, in general, involve some element of reasoning or skill and it is desired to avoid "rushing" the players, the eligibility for the community event, such as the Big Event bonus, and/or any multipliers potentially associated therewith, may be made predominantly contingent upon game play rather than wagers. In this manner, eligibility and/or multipliers will not be based solely on a time between wagers or an amount of wagers. However, eligibility and/or multipliers may still optionally be based, in part, upon on a time between wagers or an amount of wagers. In at least some aspects of the present concepts, the Big Event multiplier may max out at a low value (e.g., 3×) so that a player does not feel that they are missing out on huge multipliers if they do not play fast.

Additionally, eligibility and/or multipliers may yet be based wholly upon on a time between wagers or an amount of wagers even in card-based wagering games. In such aspects, the number of time slices awarded per credit, the number of time slices awarded per credit, the number of additional extra credits wagered, or any other variable, may be altered as required to provide players of certain games, such as poker-based games, sufficient time to play without undue haste.

As noted above, a plurality of tiered (e.g., 1×, 1.5×, 2×, 2.5×, 3×, etc.) community event bonus multipliers may be provided in the community event bonus game, such as the Big Event game. This tiering of the community event bonus multipliers may be optionally linked to the number of time slices accumulated by a player to award player's for having more eligibility time. For example, each multiplier level may be configured to accept only a predetermined maximum number of purchasable or obtainable time slices. For example, the "1×" community event bonus multiplier may be configured to accept, at most, x time slices of a predetermined duration (e.g., 100 ms., 250 ms., 500 ms., etc.), where x is any integer. In this example, it will be assumed that the "1×" community event bonus multiplier can accept 50 time slices for a time slice duration of 500 ms. Once the player exceeds 50 time slices for the "1×" multiplier, excess time slices are then deposited in the next higher community event bonus multiplier, "2×" in this example, and that community event bonus multiplier begins to fill with added time slices. After the "2×" multiplier is filled, the "3×" multiplier would begin to fill, and so on. The number of time slices allocated to each of the community event bonus multipliers may be the same, such as 50 time slices per multiplier, or may be different, such as 50 times slices for the "1×" community event bonus multiplier, 100 times slices for the "2×" community event bonus multiplier, and 150 times slices for the "3×" community event bonus multiplier. In another configuration, The number of time slices allocated to each of the community event bonus multipliers may initially be high, but may decrease for higher community event bonus multipliers. For example, 200 time slices may be required to surpass the "1×" community event bonus multiplier, 100 additional times slices required to fill the "2×" community event bonus multiplier, and 50 times slices to fill the "3×" community event bonus multiplier and advance to the "4×" community event bonus multiplier. At some point, the progression toward further decreases in the number of time slices required to advance to a successive community event bonus multiplier would naturally be limited. For example, in the preceding example, any multiplier above "4×" would need 50 additional times slices to fill the "4×" community event bonus multiplier and advance to a higher multiplier.

When a time-based community event bonus game is triggered, such as noted above, the player's current maximum multiplier for which he or she is then, in some aspects, applied to all awards received by that player in the bonus game. Thus, if the player has just achieved a "2×" community event bonus multiplier immediately prior to actual qualification for the community event, all awards received by that player in the community event bonus game are multiplied by "2×". In another aspect, the player's multiplier is for which he or she is then, in some aspects, applied proportionally to all awards received by that player in the bonus game. Thus, if the player has accumulated 100 time slices to achieved a "2×" community event bonus multiplier, and the community event bonus game was triggered when the player had 150 time slices total with 50 time slices in the "2×" range immediately prior to actual qualification for the community event, the awards received by that player in the community event bonus game would receive a "2×" multiplier in proportion to the player's time slices (e.g., 33% of the players award in the community event bonus would be multiplied by "2×"). In one alternative embodiment, rather than carry a community event bonus multiplier into the community event bonus game, a player may qualify for a portable pay table corresponding to a level of play of the player. Thus, instead of a multiplier, such as "2×," "3×," or the like, the players' pay table for the community event bonus game increases at each of a plurality of predetermined milestones and such pay table would be applied for that player in the community event bonus game.

With this general framework in mind, the example of one community event, Big Event Poker, will be described in relation to FIGS. 4-10. Big Event Poker is a community gaming experience that combines one or more poker games (i.e., the various gaming machines 10*a*-10*d* may play the same poker game, different poker games, or a plurality of selectable poker games) to a communal bonus using the WMS Gaming Inc. proprietary Big Event™ technology. Each gaming machine 10*a*-10*n* on the bank and/or any connected handheld gaming devices 110*a-n*, where n is any integer, are potentially eligible for Big Event Poker, as noted above. For example, players may obtain eligibility by wagering "Max Bet" and by making an additional 2 credit extra bet prior to a deal to obtain time slices to thereby become temporarily eligible for the communal Big Event bonus. In some aspects, each of the gaming machines is configured as a poker multi-game so that the players have an option of selecting a favored poker game. Additionally, the player may be provided the option of playing their choice of poker pay table, as discussed below.

FIG. 4 shows an example of a community gaming system comprising gaming machines 10*a*, 10*b*, 10*c*, 10*d* and an optional signage 60. There is no limit to the number of participating gaming machines and the number of participating gaming machines may be greater than or less than that depicted in FIG. 4. The four gaming machines 10*a*, 10*b*, 10*c*, 10*d* are of the type described above in relation to FIGS. 1*a* and 2, but could also include or could alternatively include the handheld gaming machines depicted in FIG. 1*b*. The four gaming machines 10*a*, 10*b*, 10*c*, 10*d* are interconnected or otherwise functionally related to the community gaming system and included under signage 60. The signage 60 includes a game screen 62 for displaying the community event game which, in this embodiment, is the BIG EVENT POKER™ game, and for displaying any other desired information to the players at the gaming machines 10*a-d* during, preceding, or subsequent to the community event including, but not limited to, eligibility information, award amounts, advertisements, or the like.

The signage 60, where provided, includes a signage controller (not shown) that is hardwired to or wirelessly connected to a controller associated with individual gaming machine (e.g., 10*a*, 10*b*, 10*c*, 10*d*) controllers 34 or with external systems 50 (e.g., a server, or a community event controller, etc.) associated therewith. The signage controller transmits information to and receives information from, for example, the controller 34 (see FIG. 2) in each of the four gaming machines 10*a*, 10*b*, 10*c*, 10*d* throughout the game. In other aspects, a controller 34 of a gaming machine or another controller, such as a community event controller, may be configured to control the signage operation.

In at least some aspects, the gaming system in accord with the present concepts includes a Big Event Client and an RNG Service, which may be embodied in a gaming machine (e.g., 10*a*), such as is disclosed in co-pending application WO 2007/030733 A2, filed on Mar. 15, 2007, and claiming priority to U.S. Provisional Application 60/715,991, filed on Sep. 9, 2005, each of which is incorporated by reference in its entirety herein, and each of which is assigned to the present assignee. Thus, the Big Event Client may comprise, for example, an additional software component that is added to the system memory 36 and that is controlled by the controller 34 (FIG. 2).

In some aspects, the external systems 50 include a server including a "Big Event Service" or "Big Event Coordinator," a multiplayer game log, and a signage manager. The Big Event Coordinator resides, and executes, on, for example, the server or on one of the gaming machines 10*a*-10*d*. In operation, when the Big Event Game is triggered, the RNG (or pseudo-RNG), which may be located anywhere, such as within a designated or selected gaming machine (e.g., gaming machine 10*b*), dictates one or more of the outcomes in the Big Event Game. For example, the Big Event Coordinator may request random outcomes, e.g., random numbers, from the RNG when the Big Event Game is being played or prior to play of the Big Event Game. After receiving one or more of the random outcomes from the Big Event Client, the Big Event Coordinator distributes the received random outcomes to all participating machines of the gaming machines 10*a*-10*d*.

Figure 5:
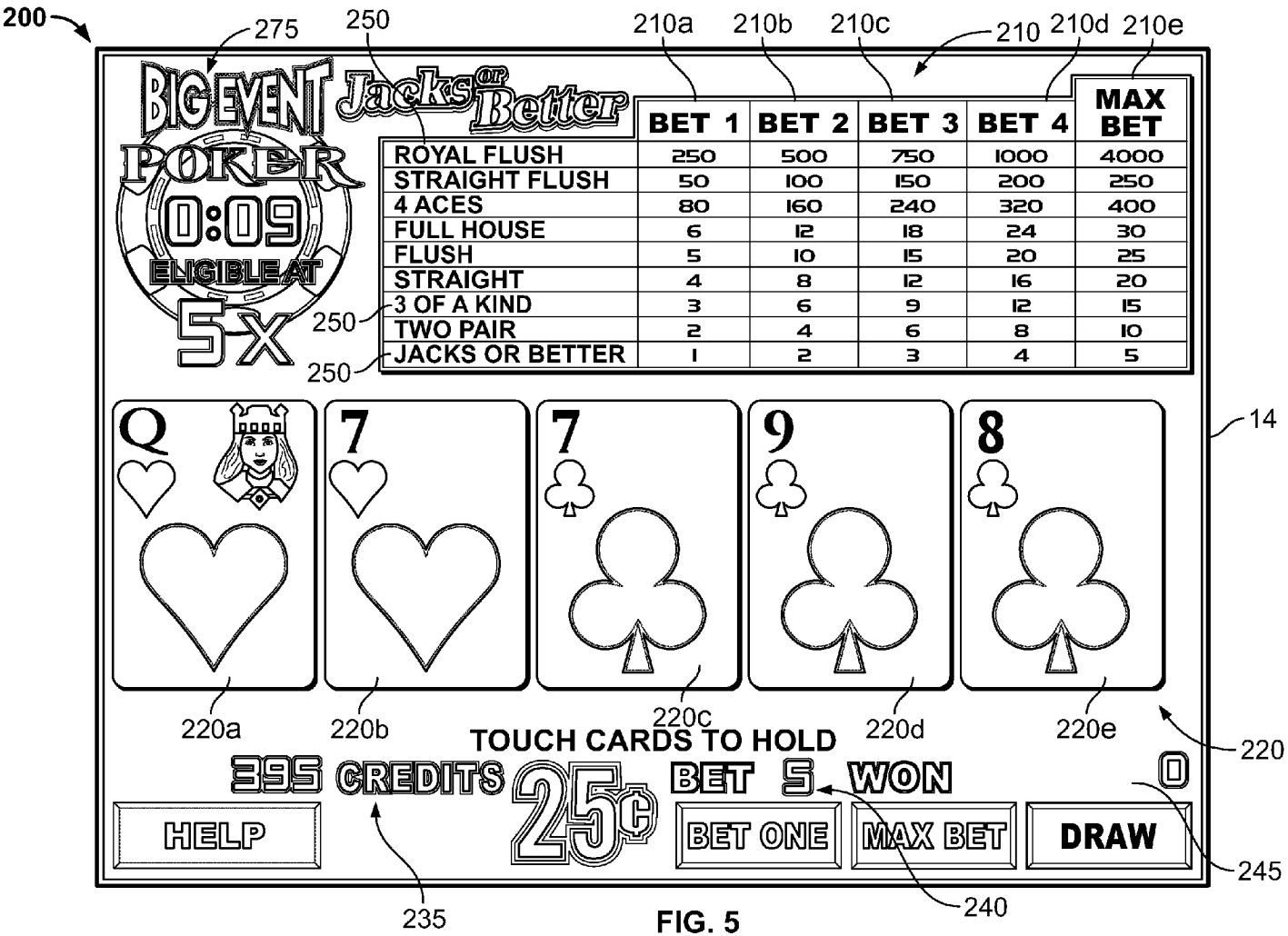
FIG. 5 depicts an illustration of a screen shot corresponding to play of a wagering game on a wagering gaming terminal representing an aspect of an embodiment of the present concepts.

FIG. 5 shows an example of a video poker screen having a selectable poker pay table 210, noted above. Prior to play, the player may select a desired one of the pay tables 210*a*-210*e* by respectively selecting a desired wager, "Bet 1," "Bet 2," "Bet 3," "Bet 4," and "Max Bet". Following the player's selection of "Max Bet" or upon a player's activation of the deal button or providing of a corresponding input or upon lapse of a predetermined period of time, the main poker game screen will display a poker hand consistent with a selected game (i.e., as noted, the gaming machines 10*a*-*n* or 110*a*-*n* may permit selection by a player of one of a plurality of different poker games). In FIG. 5, a five-card draw poker game is illustrated on the primary display 14. The user-playable hand 220 consists of a plurality of cards 220*a*-*e*. Game session meters include, but are not limited to, a "credits" meter 230 for displaying a number of credits available to play on the gaming machine 10; a "bet" meter 240 for displaying a number of credits wagered (e.g., from 1 to 5 credits) for each hand played; and a "Win" meter 250 for displaying an amount to be awarded based on the outcome of the current round.

The exemplary, but non-limiting, player-selectable buttons depicted in FIG. 5 include a "Help" button for viewing instructions on how to play the video poker game; a "Bet One" button for wagering one credit at a time; a "Max Bet" button for wagering a maximum number of credits (e.g., 5 credits); and a "Deal/Draw" button for causing the game to initially deal a plurality of cards face-up from a deck to form the user-playable hand 220 or for causing the game to replace all non-held card(s) in the previously dealt user-playable hand with another card from the deck. Although not shown in FIG. 5, the main poker game screen 200 is also configured to display a plurality of hold buttons for allowing a player to select a card to hold or, alternatively, other player input devices (e.g., buttons 24) or graphical user interfaces (GUIs) provided to permit such selection by the player. It is contemplated that the primary display (e.g., 14, 114), button panel, or other player-to-machine interfaces may include game session meters and/or player-selectable buttons other than, or in addition to, those described herein.

In accord with at least some aspects of the present concepts, the video poker display 200 also includes a community event eligibility meter 275 showing the community event for which eligibility may be obtained on the gaming machine 10. Optionally, the player may be permitted to associate an eligibility with a selected one of a plurality of available community event games or to distribute an eligibility across a plurality of such available community event games. FIG. 5 shows that the community event eligibility meter 275 is associated with the "Big Event Poker" community event game and that the player has 9 seconds of eligibility at a Big Event multiplier of "5×". As the player sits staring at the hand, the timer on the community event eligibility meter 275 ticks down second by second. However, as long as the player has eligibility time, they remain eligible for the Big Event bonus whether the player is playing or is idle.

In some aspects, when the timer on the community event eligibility meter 275 reaches zero, the player is ineligible for the community event even though the player may have been, as shown, at a multiplier level of "5×". In still other aspects, the displayed 9 seconds of eligibility may pertain only to the duration of eligibility for the community bonus event at a multiplier level of "5×," and does not depict the time slices that might have been required for the player to reach the "5×" level. For example, if the player had to obtain (and maintain) 50 time slices for each level of community event bonus multiplier, the player would have needed at least 250 time slices to reach the "5×" community event bonus multiplier. If the time slices were each 250 ms., for example, the player would have accumulated about 62 seconds or one minute of eligibility. Therefore, in such example, the 9 seconds indicate, for example, 9 seconds of eligibility at "5×", followed by 12½ seconds of eligibility at each of the community event bonus multipliers of "4×," "3×," "2×," and "1×," before eligibility is lost, barring no additional award of or purchase of time slices. Should the Big Event bonus be triggered while the player still has eligibility remaining, the multiplier will multiply the players' Big Event bonus.

The pay table 200, displayed on the primary display 14 in the present example, may also or alternatively be displayed on the secondary display 16. The pay table 200 includes a list of winning poker hand rankings 280 for the depicted example of "Jacks or Better," consisting of "Royal Flush," "Straight Flush," "4 Aces," "Full House," "Flush," "Straight," "3 of a Kind," "Two Pair," and "Jacks or Better." The pay table 200 also includes a number of payout columns 210*a*-210*e* labeled "Bet 1," "Bet 2," "Bet 3," "Bet 4," and "Bet 5" displaying payouts associated with each ranking relative to the player's wager. As is evident by a comparison of any one of the winning poker hand rankings 280 to each of the columns 210*a*-210*e*, it can be seen that the number of credits won is linearly proportional to the number of credits wagered for a given winning poker hand, except that a royal flush yields a bonus when achieved on a maximum wager. The winning poker hand rankings 280 includes standard poker hand rankings beginning at "Jacks or Better" up to and including a "Royal Flush."

As illustrated in FIG. 5, a player has selected to wager five credits (displayed in the bet meter 240). By choosing to wager five credits, the player is playing for the number of credits shown in the "Max Bet" column 210*e* displayed in the pay table 210.

By selecting the "Deal/Draw" button 250, a player is dealt a user-playable hand 220. In a five-card draw poker game, such as a "Jacks or Better," five cards 220*a*-*e* are displayed face-up to a player to form a first user-playable hand. The player is able to select none, one, or a plurality of the cards 220*a*-*e* in the user-playable hand to hold, such as by touching the cards that are desired to be held. Optionally, any cards that already contribute to a winning outcome may be highlighted to the player to assist the player in determining which cards to hold and/or discard.

At the end of any discard and dealing of a second user-playable hand, which may, but is not required to, include one or more held cards from the first user-playable hand, a player is awarded a pay out as displayed in the pay table 210 if the ranking of the hand meets one of the plurality of predetermined criteria displayed in the pay table. Likewise, a player is not awarded a pay out if the ranking of the hand does not meet one of the plurality of predetermined criteria displayed in the pay table 210.

Figure 6:
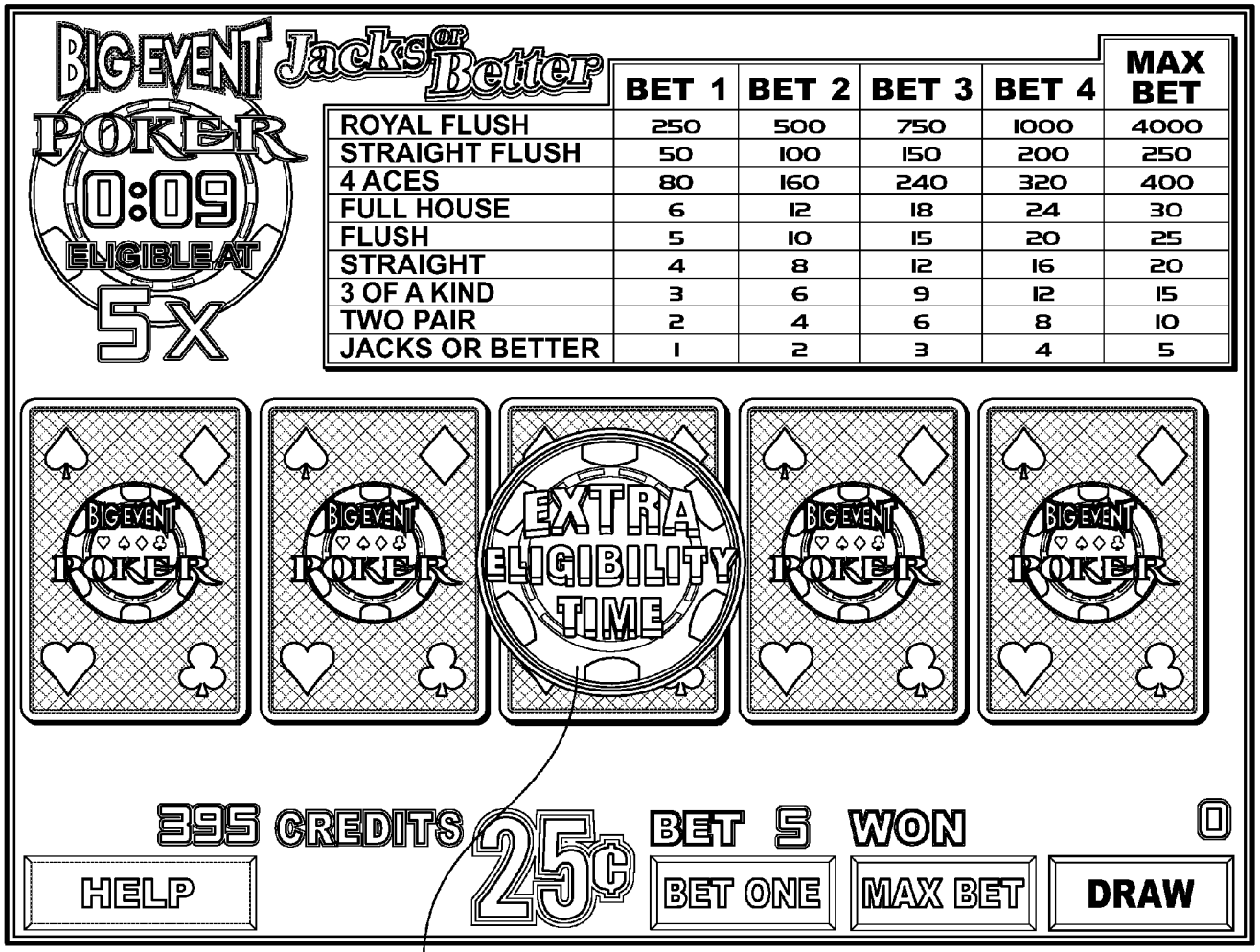
FIG. 6 depicts another illustration of a screen shot corresponding to play of a wagering game on a wagering gaming terminal representing an aspect of an embodiment of the present concepts.

FIG. 6 depicts a situation in which extra eligibility time is awarded to a player during game play, such as was noted above. In the example of FIG. 6, the player is randomly awarded "Extra Eligibility Time" at a time after the deal, but before the reveal of the dealt hand. An icon or image of a poker chip 300 bearing "Extra Eligibility Time" is displayed prominently on the display 200 to inform the player that the player has been awarded additional time slices which are then added to the current time of eligibility. The amount of time, or number of time slices awarded, could comprise any desired amount of time (e.g., 5 seconds, 10, seconds, 15 seconds, 30 seconds, 1 minute, 2 minutes, etc.), which may or may not affect the players' Bonus Event multiplier. Such time, although not shown in FIG. 6, may appear in a pop-up, banner, or the like, or may appear on the icon or image of a poker chip 300, together with the award notification or following a fade away of the award notification to build excitement and anticipation. Likewise, as previously noted, another way in which additional time slices may be awarded to a player would be to randomly associate an "Extra Eligibility Time" award with one or more cards within the deck(s) prior to the deck(s) shuffle and prior to the dealing of the cards to the player. Once the "Extra Eligibility Time" award associated cards are dealt to the player, the player is awarded the extra eligibility time.

In at least some aspects of embodiments of the present concepts, this random award of extra eligibility time could be used to equalize the different EVs for various poker games offered on the gaming machines 10*a*-10*n*. For example, if one player is playing "Deuces Wild" (higher EV) and another is playing standard "Jacks or Better" (lower EV), the "Jacks or Better" player may be given additional eligibility time more often than the "Deuces Wild" player.

Figure 7:
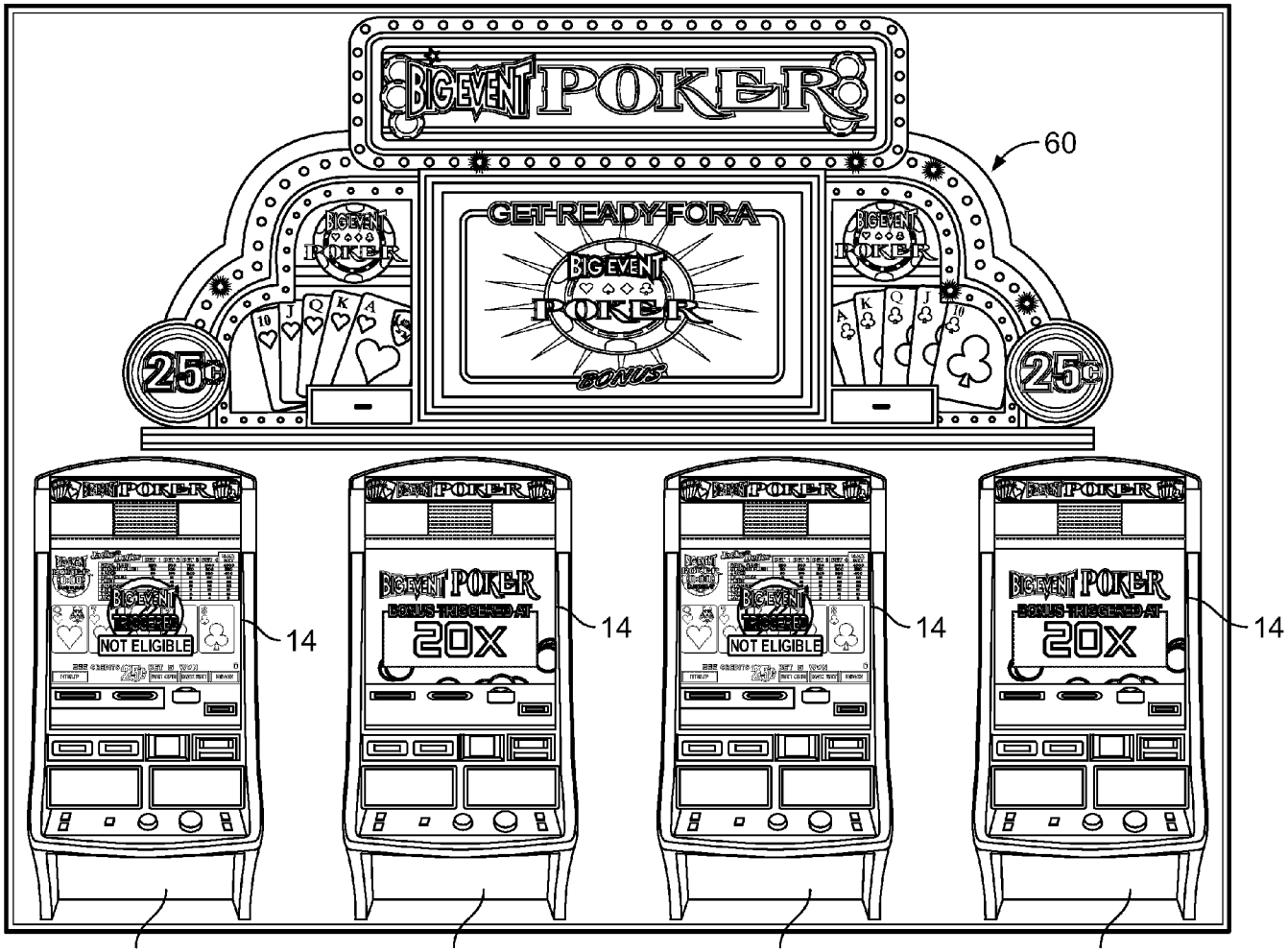
FIG. 7 depicts an initiation of a community event on the community gaming system shown in FIG. 4 in accord with an aspect of at least one embodiment of the present concepts.

When a Big Event poker bonus is triggered, such as is shown in FIG. 7, all eligible players are displayed, on display 14, an on-screen graphic on the gaming machine (e.g., 10*b*, 10*d*) showing each player that they are about to enter a community event bonus game. Likewise, any player of a gaming machine (e.g., 10*a*, 10*c*) that is not eligible is displayed, on display 14, an on-screen graphic showing them that they are not eligible for the community event bonus game. Signage 60 also advantageously displays graphics introducing the community event bonus game (e.g., Big Event Poker).

Although, in some embodiments, only one Big Event bonus may be available to a given bank of gaming machines 10*a*-*n*, 110*a*-*n* (e.g., 10*a*-10*d*, as shown in FIG. 7), other embodiments may advantageously cycle through a plurality of available Big Event bonus games randomly, pseudo-randomly, or in accord with a schedule. This variability keeps the game fresh and enhances long-term excitement. In accord with such aspects, the signage 60 above the bank corresponding to the Big Event bonus to be played shows the eligible players which of the Big Event bonuses is about to be played.

Figure 8:
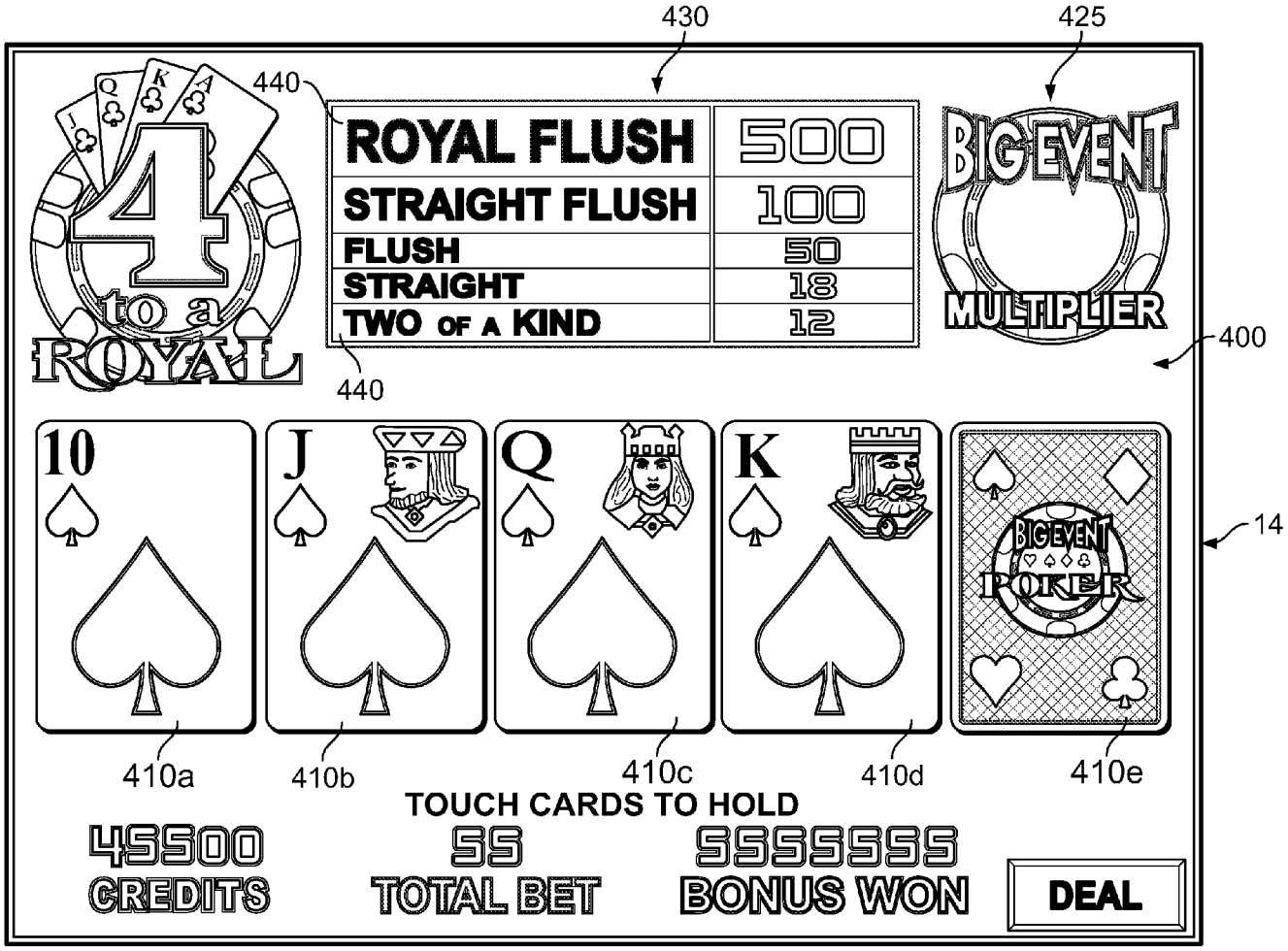
FIG. 8 depicts an illustration of a screen shot corresponding to play of a community wagering game on a wagering gaming terminal representing an aspect of an embodiment of the present concepts.

FIG. 8 shows an illustrative display 400 of a Big Event bonus game called "4 to a Royal"™. If the triggered Big Event communal bonus is "4 to a Royal,"™ then all eligible players' base games display a new communal poker base game with 4 of the cards 410*a*-410*d* collectively indicating a potential royal flush hand and the last card 410*e* is face down. Although the illustrative display 400 in FIG. 8 indicates that the player is required to touch the cards that are desired to be held, the holding of the cards 410*a*-410*d* may, in the alternative, be automatic or may permit the use of alternative player inputs.

In FIG. 8, the community event bonus eligibility meter 275 shown in preceding figures, such as FIG. 5, is no longer relevant and is omitted in the Big Event bonus game display 400. Instead, a Big Event multiplier meter 425 is shown in the upper right hand corner of display 400 in the example of FIG. 8. However, since the player in the illustrated example has no enhanced Big Event bonus multiplier, nothing is shown. Alternatively, "1×" could be shown. Were the player to have had an enhanced Big Event bonus multiplier, such would have been shown in the Big Event multiplier meter 425. Also shown is a pay table 430 that includes a list of winning poker hand rankings 440 for the depicted example of "4 to a Royal, "™ consisting of "Royal Flush," "Straight Flush," "Flush," "Straight," and "2 of a Kind," consistent with the potential combinations that may be revealed by the last card 410*e*. Only one pay column is shown.

In alternative embodiments, each player may carry into the "4 to a Royal"™ bonus game, or other community event bonus game, his or her own pay table corresponding to a pay table played by the player on the gaming machine 10, 110 at the time of triggering of the "4 to a Royal"™ bonus game.

In "4 to a Royal,"™ each eligible players' base games will use its own deck(s) of cards, so it is possible for all eligible players to get a Royal Flush. In other words, in a presently preferred aspect of this bonus game, each eligible player playing "4 to a Royal,"™ have an independent chance of receiving any of the awards, including the maximum award for the "Royal Flush." However, in an alternative aspect of the present concepts, each eligible player playing "4 to a Royal, "™ receives a randomly selected outcome from a limited population of potential outcomes, such as each eligible player selecting a draw from the same deck of x cards (e.g., a multi-deck "shoe"), wherein the number of cards in the deck(s) may be scaled up or down based on the number of eligible players.

Figure 9:
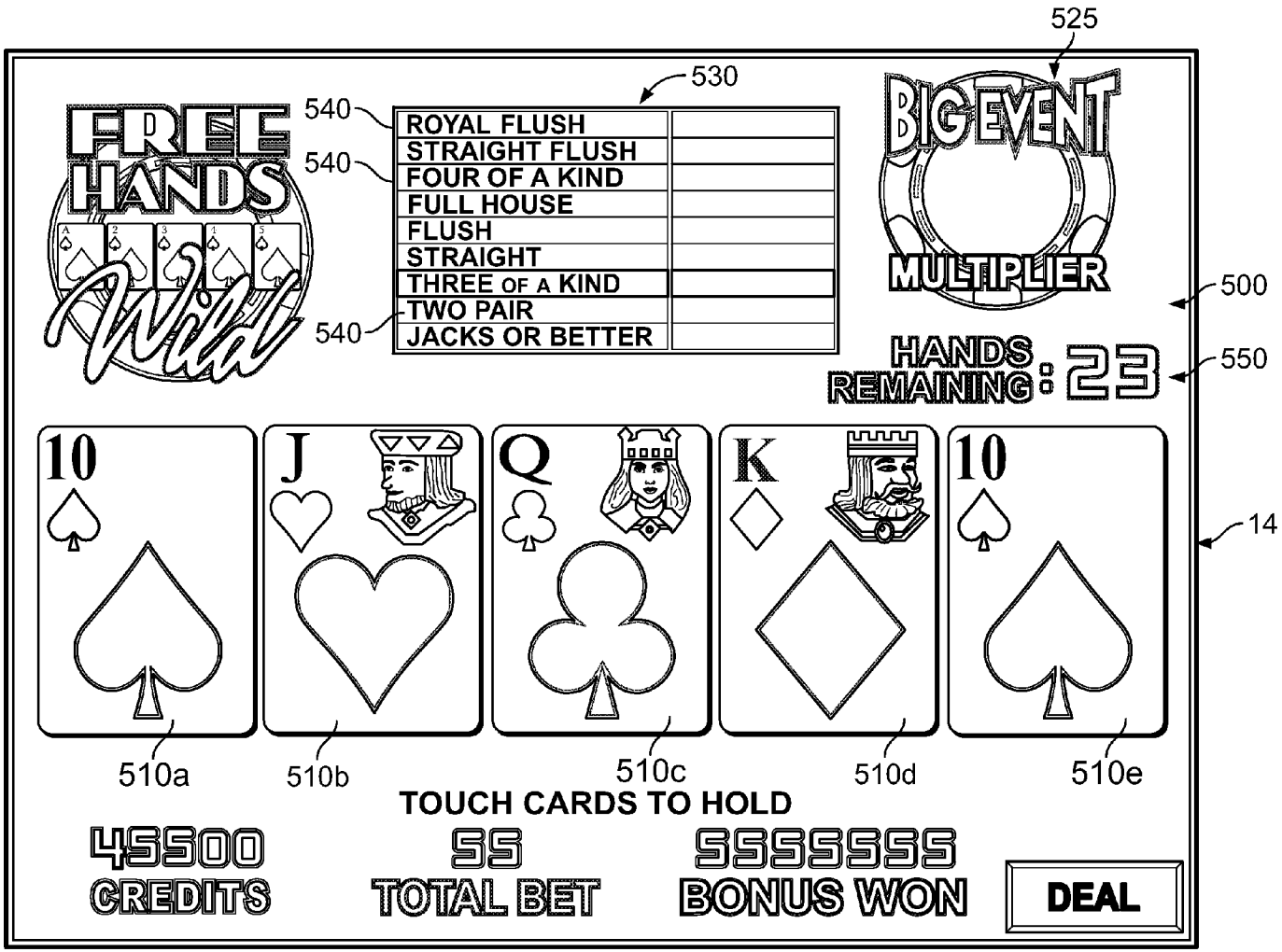
FIG. 9 depicts an illustration of a screen shot corresponding to play of another community wagering game on a wagering gaming terminal representing an aspect of an embodiment of the present concepts.

FIG. 9 depicts an illustrative display 500 of a Big Event bonus game called "Free Hands Wild."™ If the triggered Big Event communal bonus is "Free Hands Wild,"™ then all eligible players' base games display a new communal poker base game wherein the players play out a predetermined number of free hands of poker comprising cards 510*a*-510*e* or play free hands of poker for a predetermined time. In "Free Hands Wild,"™ as with "4 to a Royal,"™ each eligible players' base games will use its own deck(s) of cards, so all eligible players enjoy the same probabilities of obtaining the winning hands indicated in the players' pay tables including, but not limited to, the depicted list of winning poker hand rankings 540 for the depicted example consisting of "Royal Flush," "Straight Flush," "Four of a Kind," "Full House," "Flush," "Straight," "Three of a Kind," "Two Pair," and "Jacks or Better." Thus, it is possible for each of the eligible players to win different amounts and to experience unique community bonus event game play experiences. However, as noted above, in an alternative aspect of the present concepts, each eligible player playing "Free Hands Wild,"™ receives a randomly selected outcome from a limited population of potential outcomes, such as each eligible player selecting a draw from the same deck of x cards (e.g., a multi-deck "shoe"), wherein the number of cards in the deck(s) may be scaled up or down based on the number of eligible players.

The pay table 530, as depicted, is blank to represent the variability of the pay table in the illustrated aspect of the community event bonus game. In such aspect, the pay table that the player uses in the community event bonus game, here "Free Hands Wild,"™ is the same pay table that the player selected and/or used as the pay table in their base poker at the time that the community event bonus game was triggered. Alternatively, the pay table used by the player in the community event bonus game may be selected by other criteria or in other manners. In one aspect, the pay table could be randomly selected. In another aspect, the pay table could represent a weighted average of the players' historical play of the base wagering game preceding the triggering of the community event bonus game. For example, if the player had been placing "Max Bet" wagers consistently for 30 minutes and happened to place a "Bet 1" wager immediately prior to the triggering of the community event bonus game, the community event bonus game eligible player may be given a "Max Bet" pay table to play in the community event bonus game, despite one or more incidental low wager plays. In such aspects, a "Pay Table" meter on the display could provide an indication to the player of the pay table for which he or she is qualified at any given moment. In still further aspects, the pay table selected for use by the player in the community event bonus game could be related not to any particular wager placed by the player, but by the number of time slices obtained or maintained by the player at the time of triggering of the community event bonus game. Weighting factors could also be levied to reward desired aspects of game play (e.g., consistency, high wagers, etc.).

FIG. 9 also shows a "Hands Remaining" meter 550 showing that a player has "23" hands of poker remaining. In this example, each player may play his or her dealt hands at leisure, without onerous time constraints. In another variant, as noted above, each player may be allotted a predetermined amount of time in which the player is permitted to play as many hands as possible. The predetermined amount of time may be, for example, fixed for all eligible players, randomly determined for all eligible players, or player dependent (e.g., dependent upon a number of time slices obtained by each player). The number of hands or the amount of time available to any particular player may optionally be randomly increased during game play in the community event bonus game. For example, similar to the example noted above with respect to FIG. 6, extra "Free Time" may be granted to a player in a time-based "Free Hands Wild"™ community bonus game or "Extra Free Hands" may be granted to a player in a number-of-play-based "Free Hands Wild"™ community bonus game. In one aspect, an extra time or an extra hands award may be randomly associated with one or more cards in the deck(s) of cards and such award awarded to a player upon either a deal of the card or a reveal of the card to the player.

Figure 10:
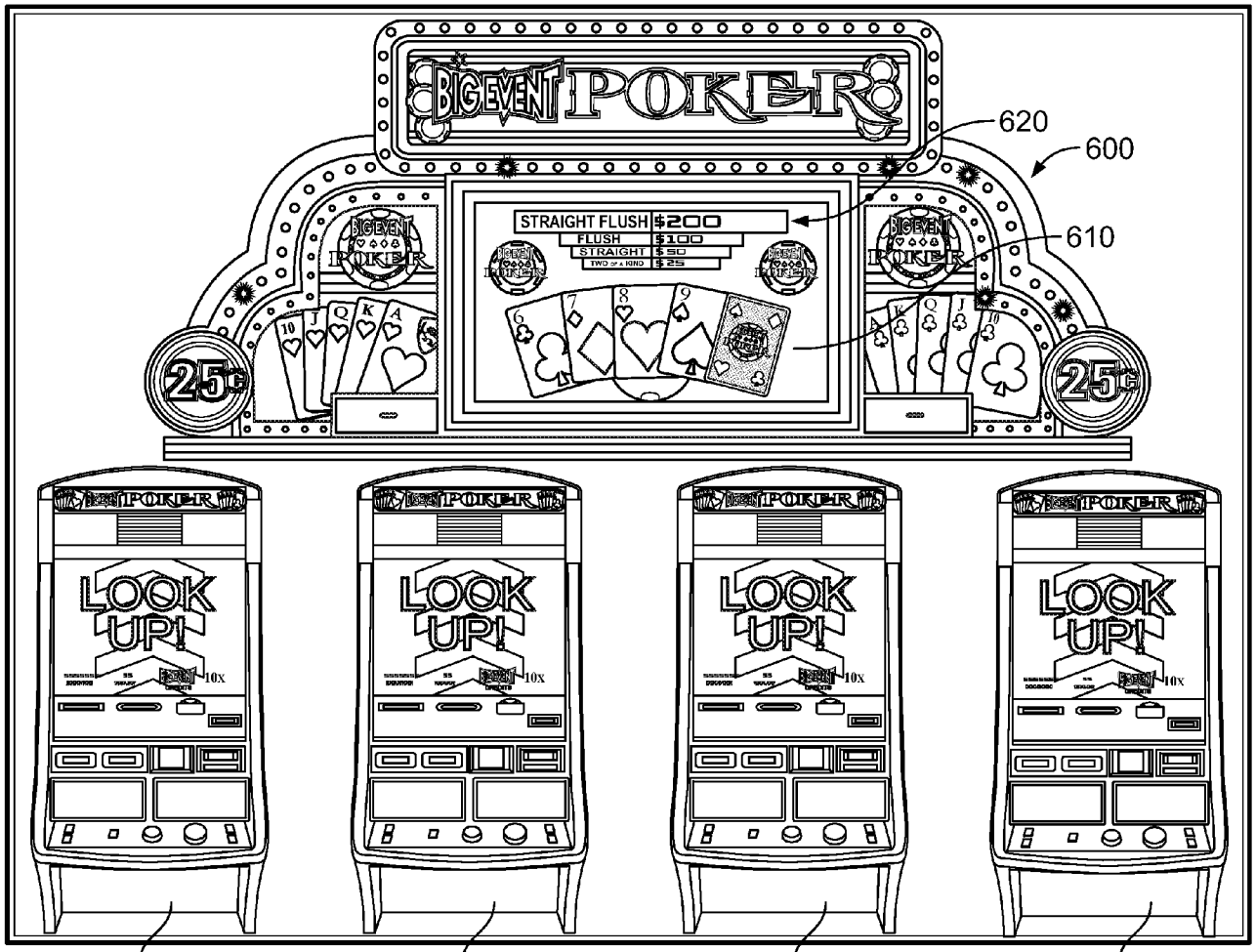
FIG. 10 depicts play of a community event on the community gaming system shown in FIG. 4 in accord with an aspect of at least one embodiment of the present concepts.

FIG. 10 shows another example of a Big Event Poker bonus game called "Poker Pots"™. If the triggered Big Event communal bonus is "Poker Pots,"™ then all eligible players, the players at gaming machines 10*a*-10*d* in the example shown in FIG. 10, are prompted to look up to the signage 600, such as by colorful and bold text, arrows, and/or flashing lights directing the players' attention upward. The signage comprises a display 610, which may include any display type such as, but not limited to, a plasma display or an LCD. On the display 610 is shown a plurality of dealt cards. The cards may be dealt in any manner. For example, the cards may be dealt face down until all cards are dealt and then revealed one by one, the cards may be sequentially dealt face up, some cards may be dealt face down and others face up, or the cards may be fanned out. In the illustrated example, the cards are fanned out with four cards face up and one card face down. The pay table 620 shows various possible winning outcomes which are depicted as, but are not limited to, "Straight Flush," "Flush," "Straight," and "Two of a Kind." As depicted in the example of FIG. 10, the dealt hand includes a "6 of clubs," "7 of diamonds," "8 of hearts," and "9 of spades." After a slight delay to buildup anticipation prior to the final reveal of the winning outcome, the final card is flipped to reveal the randomly determined winning outcome and the award corresponding to the winning hand is awarded to all of the eligible players, times any applicable Big Event multiplier (e.g., 2×, 3×, etc.) carried by each player.

Although a number of potential poker related community event bonus games have been shown, the present concepts are not limited to the depicted examples and may include any poker-themed game or, more generally, card-based game.

In the transition from the base wagering game to the Big Event, where a plurality of community event bonus games may be selected, such as by, but not limited to, random selection, the signage (e.g., 60, FIG. 7) may graphically indicate the result of the selection in a manner suitable for heightening anticipation. For example, a spinning wheel having thereon the names of the different possible bonus games in different sectors may spin and slow to reveal the outcome. The stopping of the wheel may be on the ultimate outcome or an intermediate outcome, wherein the wheel is then nudged to reveal the ultimate outcome.

Since players at different gaming machines 10, 110 may be permitted to play different poker-based base wagering games, each having a different EV, it is desirable to equalize the EVs between the base wagering games using the Big Event. For example, the "Jacks or Better" player may be given, in the Big Event bonus, a more beneficial award (e.g., a higher credit value) than the "Deuces Wild" player. As another example, if the Big Event bonus game is a "Free Hands" game, discussed in relation to FIG. 9, the "Jacks or Better" player may be given x more hands, where x is an integer (e.g., 5) than the "Deuces Wild" player, as the "Deuces Wild" player is likely to win more money on a per hand basis than the "Jacks or Better" player. In this way, the Big Event EV, or the overall wagering games' EVs can be standardized. Such equalization of the EVs across a plurality of wagering games implementing different wagering games, whether of a common theme or not, may be achieved through variations introduced in the Big Event community bonus game(s) including, but not limited to, adopting different pay tables for different games, providing additional hands, providing additional time, providing higher multipliers, providing higher award amounts, etcetera.

In another aspect of the present concepts, EVs among a bank of gaming machines 10, 110 playing different poker-based base wagering games and having different EVs may be equalized by awarding different numbers of and/or durations of time slices. For example, where extra eligibility time is automatically granted for an extra wager above the "Max Bet" wager, the "Jacks or Better" player may be given more time slices or time slices of a greater duration for a given extra wager equating to, for example, an extra half second, second, two seconds, etcetera, than the "Deuces Wild" player. As another example, where extra eligibility time is randomly awarded during game play, the "Jacks or Better" player may be given more time slices or time slices of a greater duration equating to, for example, an extra half second, second, two seconds, etcetera, than the "Deuces Wild" player, or alternatively may be given the same number and/or duration of time slice at a greater frequency than the "Deuces Wild" player.

In any of the above aspects, a player may also optionally be permitted to save a state of his or her play on the base wagering game, in association with a suitable player identification (e.g., player club ID number, biometric input, etc.) to save for a subsequent use the player's accumulated eligibility time and/or community event bonus multipliers. The state of play may further be saved in association with an originating gaming machine or alternatively, an EV of the particular base wagering game, to permit ready conversion of or integration of the accumulated eligibility time and/or community event bonus multipliers into another gaming machine, of the same type of the originating gaming machine or of a different type, supporting the same community game.

The state of play may further be saved in association with an EV of the community event bonus game(s) for which the player is maintaining an eligibility qualification state. Thus, if a player is originally playing a first wagering game (e.g., video poker) on a handheld gaming terminal 110 to qualify for a first community event (e.g., Big Event Poker™), saves a state of play including a first value for a bonus-time eligibility counter and a first value for a community event bonus multiplier, and the player later decides to play a second wagering game (e.g., Monopoly® Super Grand Hotel™) on a gaming machine 10 to qualify for and play a second community event (e.g., Big Event Monopoly™) the player's saved state from the first wagering game could be readily converted to a second value for a bonus-time eligibility counter and a second value for a community event bonus multiplier, if required, in accord with any variances in the base wagering game EVs and/or the community bonus EVs. In accord with the present concepts, the player's eligibility state for the community event is not only portable, but eminently fungible.

Accordingly, the present concepts include a method of conducting a wagering game on a gaming system including a plurality of gaming machines 10, 110 comprising the act of conducting a community event bonus game and awarding one or more awards to each eligible player. In this method, consistent with the above disclosure, the act of awarding one or more awards comprises awarding, a first value of awards to players who obtained eligibility for the community event bonus game on a first base wagering game having a first EV and awarding a second value of awards to players who obtained eligibility for the community event bonus game on a second base wagering game having a second EV lower than the first EV wherein the first value of awards is statistically lower than the second value of awards.

In another aspect, a method in accord with the present concepts comprises the acts of conducting a community event bonus game and awarding one or more awards to each eligible player, wherein the act of awarding one or more awards to each eligible player comprises discriminating between players of base wagering games having different EVs, applying a first community event bonus EV to players of base wagering games having a first EV, and applying a second community event bonus EV to players of base wagering games having a second EV. In this method, the first community event bonus EV is lower than the second community event bonus EV, the first EV is higher than the second EV, and the sum of the EVs of the first community event bonus EV and the first EV is at least substantially the same as the sum of the EVs of the second community event bonus EV and the second EV. The first and second community event bonus EVs may be adjusted by any practicable mechanism including, but not limited to, adjustment of pay tables, award values, award frequency, extra plays of the community event bonus game, extra time for playing the community event bonus game, extra picks in a picking-based community event bonus game, multiplier values, or the like. Thus, a player benefiting from a slightly higher base wagering game EV may enjoy a slightly lower community bonus event EV than a player at another gaming machine having a slightly lower base wagering game EV. On average, players of the base wagering games having different EVs will have substantially equal payback or return percentages.

Thus, as noted above, the awards in the community event bonus game may differentially treat the players who achieved eligibility for the community event bonus game on base wagering games having different EVs. This differential treatment is a mechanism by which the overall EV for differing base wagering games may be at least substantially equalized through the general act of awarding awards in the community event bonus game. Preferably, this equalization will bring the overall EV of the combination of the base wagering game and the community event bonus game, as between the first base wagering game and the second base wagering game, to within 2% of one another and, still more preferably, within 1% of one another and, still more preferably, within 0.25% of one another, when viewed over a statistically significant period of time. Naturally, the equalization may strive to bring the overall EV of the combination of the base wagering game and the community event bonus game, as between the first base wagering game and the second base wagering game, to absolute parity.

Moreover, the variances permitted by the present concepts in eligibility time for a community event, qualification for community event bonus multipliers, and community event awards (e.g., extra time granted during play of the community event, higher multipliers granted during play of the community event, higher awards granted during play of the community event in relation to an EV of an originating gaming machine, etc.) permit equalization of the EV not only as between gaming machines 10, 110 playing different base wagering games, but also permit equalization of EVs between different community events.

Figure 11:
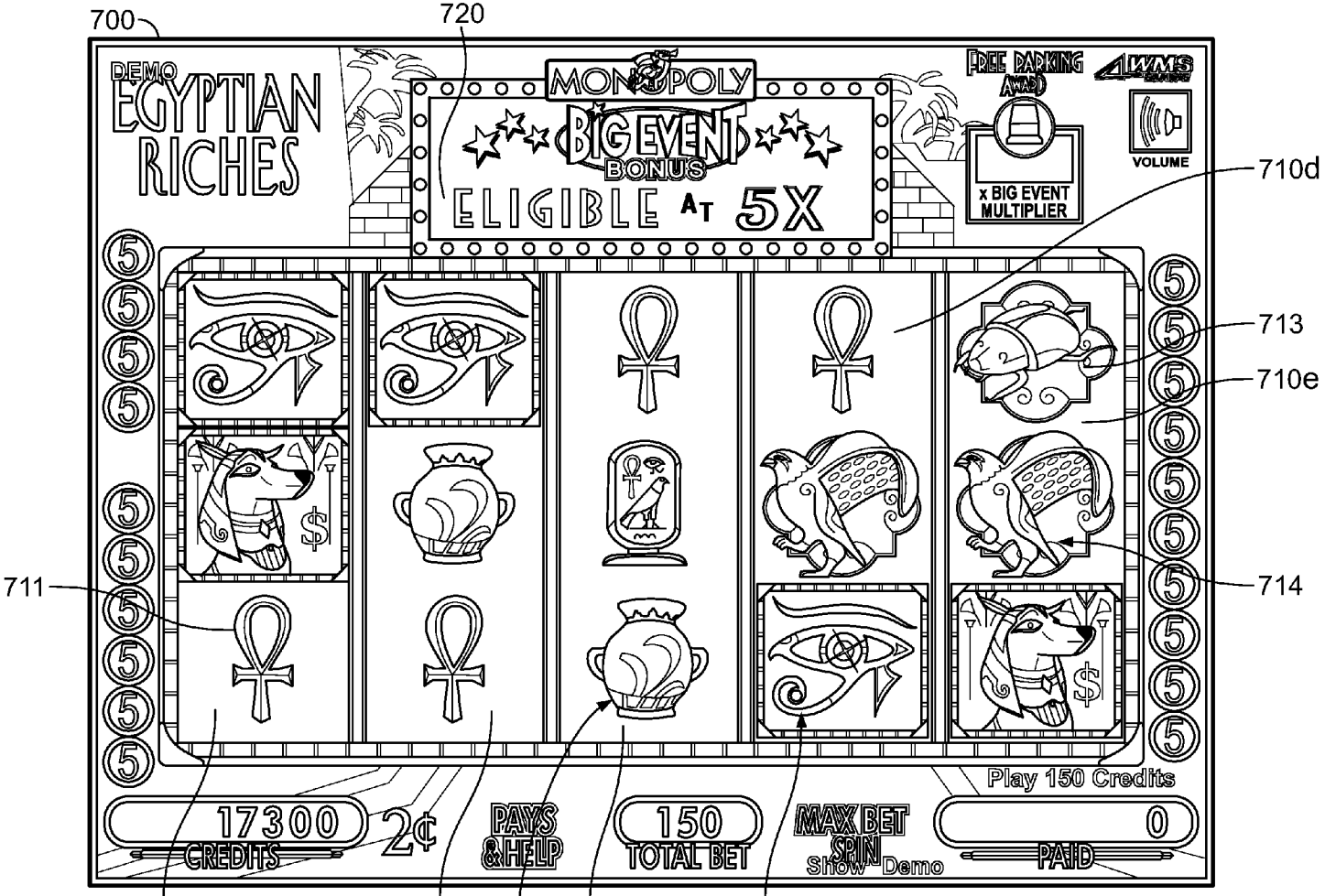
FIG. 11 depicts an illustration of a screen shot corresponding to a slot machine wagering game representing an aspect of an embodiment of the present concepts.
Figure 12:
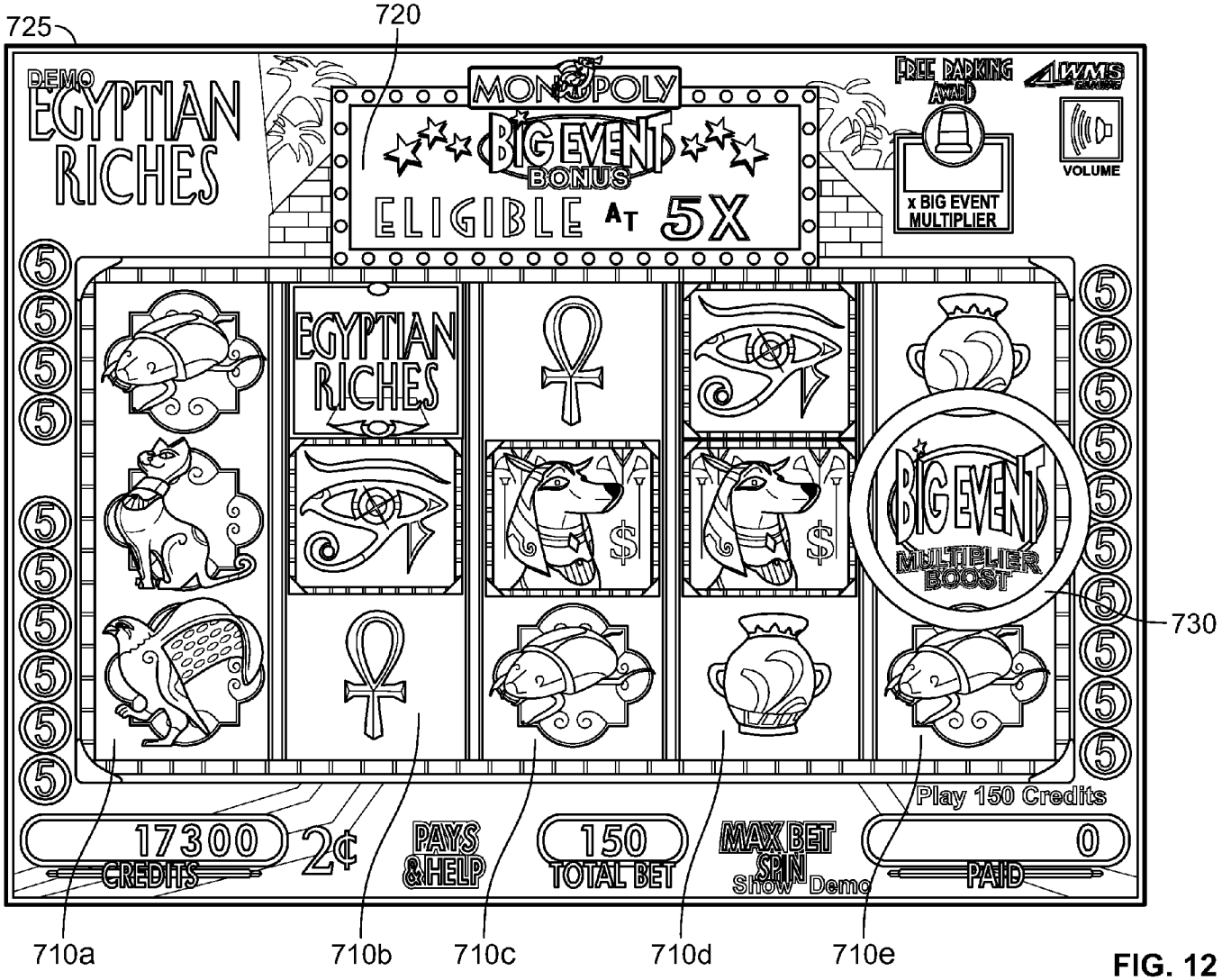
FIG. 12 depicts an illustration of a screen shot of the slot machine wagering game of FIG. 11, representing an aspect of an embodiment of the present concepts.
Figure 13:
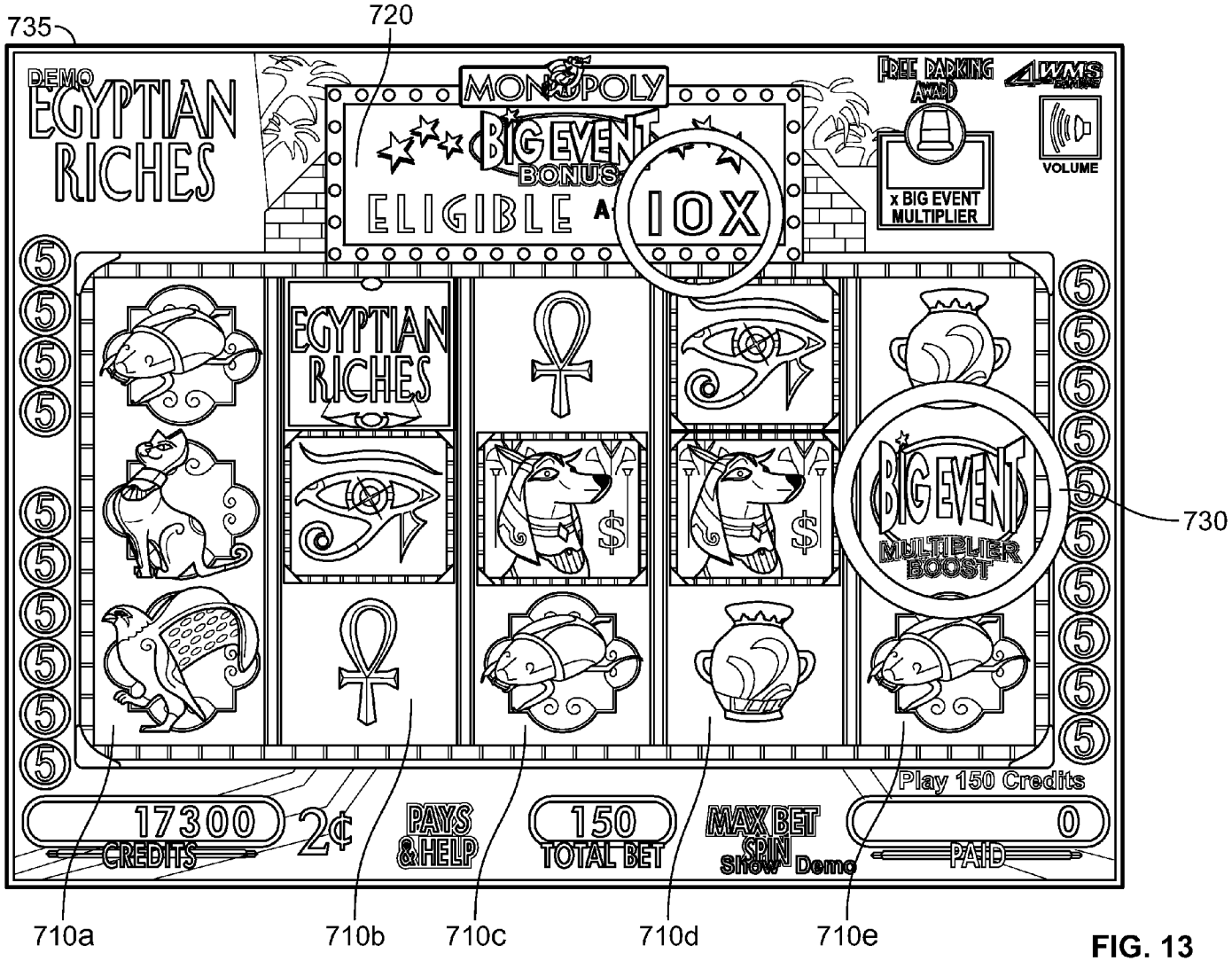
FIG. 13 depicts an illustration of a screen shot of the slot machine wagering game of FIGS. 11-12, representing an aspect of an embodiment of the present concepts.

FIGS. 11-13 show still another aspect of the present concepts. Whereas the preceding examples related to determining eligibility of a player to participate in a community event during the player's play of a card-related wagering game, the concepts disclosed herein are also applicable to other types of wagering games including, but not limited to, slot machine games and table top games, such as roulette.

In the example of FIGS. 11-13, a plurality of tiered (e.g., 1×, 5×, 10×, 15×, 20×, etc.) community event bonus multipliers are provided in the community event bonus game, such as the Monopoly® Big Event game. The tiering of the community event bonus multipliers are linked, in this example, to the number of time slices accumulated by a player to award player's for having more eligibility time. Each multiplier level is configured to accept only a predetermined maximum number of purchasable or obtainable time slices. For example, the "1×" community event bonus multiplier is configured to accept, at most, x time slices of a predetermined duration (e.g., 100 ms., 250 ms., 500 ms., etc.), where x is any integer. Once the player exceeds the x time slices for the "1×" multiplier, excess time slices are then deposited in the next higher community event bonus multiplier (e.g., "5×") and that community event bonus multiplier begins to fill with added time slices. Each tier may consist of the same of time slices (e.g., x time slices) or, alternatively, the number of time slices to fill each level may be different from that of the preceding tier(s). For example, a multiplier tier may require additional time slices above that required in a preceding tier or tiers. Thus, a "5×" tier may optionally require y time slices before the player can progress to the next multiplier (e.g., "10×"), whereas y>x. Alternatively, a multiplier tier may require fewer time slices than required in a preceding tier or tiers. In still other alternative embodiments, the duration of each time slice (instead of the number of time slices) could vary as between different multiplier tiers.

FIG. 11 shows a first screen shot 700 of a wagering game comprising a plurality of reels, or simulated reels, 710*a*-710*f*, each reel defining a plurality of symbol positions on which themed symbols of the wagering game are presented. Alternatively, each symbol position could be represented by a different simulated reel. In the example illustrated in FIGS. 11-13, the theme is "Egyptian Riches" and the themed symbols include an Ankh 711, a vase 712, a scarab 713, a falcon 714, and an Eye of Horus 715. Also shown in the screen shot 700 is a banner 720 for the Big Event Bonus showing that the player is "Eligible at 5×". Thus, the player is eligible for the Big Event Bonus and, should the Big Event Bonus be triggered while the player retains this status of eligibility and multiplier, awards accrued by the player in the Big Event Bonus will be multiplied by 5×. FIG. 12 shows a second screen shot 725 wherein a center symbol position on reel 710*e* bears a community bonus game symbol 730, depicted in FIG. 12 as a "BIG EVENT MULTIPLIER BOOST" symbol. FIG. 13 depicts an alteration in the banner 720 for the Big Event Bonus immediately subsequent to the reveal of the community bonus game symbol 730, the "BIG EVENT MULTIPLIER BOOST" as shown, showing that the player is now "Eligible at 10×" so that, should the Big Event Bonus be triggered while the player retains this status of eligibility and multiplier, awards accrued by the player in the Big Event Bonus will be multiplied by 10×.

As with some of the aforementioned aspects, community bonus game symbols 730 may be enabled or displayed only responsive to a minimum threshold wager or to an additional wager further to the maximum standard wager. For example, the community bonus game symbols 730 may be enabled or displayed only when the player makes a "Max Bet" wager and places an additional 1 or 2 credit extra wager. In another example, the number of community bonus game symbols 730 may itself be influenced by the amount of the base wager and/or any required extra wager. In such aspects, the odds of attaining one or more special community bonus game symbol(s) 730 may be improved with larger wagers and extra wagers.

It is to be noted that, although a single community bonus game symbol 730 is shown in FIG. 13, various aspects of the present concepts may permit a player to attain a plurality of community bonus game symbols 730 in association with a base wagering game outcome. As noted above, the number of community bonus game symbols 730 potentially available to a player may be directly influenced by the player's wager and/or any extra wager placed by the player.

Any realized community bonus game symbol 730 providing increased awards (e.g., multiplier, etc.) or increased odds at winning an award or awards in the community bonus game, such as the "BIG EVENT MULTIPLIER BOOST" symbol shown in FIG. 13, may be optionally extinguished or inactivated if the player, at any time, runs out of time slices. Thus, in such a configuration, the player would be motivated to ensure that he or she maintains the potential for eligibility for the community bonus game.

In still additional aspects, the player may receive the indicated benefit of a community bonus game symbols 730 only if the community bonus game symbols 730 forms a part of a winning outcome that exceeds a predetermined win threshold. For example, the win threshold may be a winning outcome that is 30× the player's wager or some other multiple of the player's wager. Another precondition may also operate to additionally require a minimum wager, such as a "Max Bet" wager. In any of these aspects, the benefit associated with the community bonus game symbol 730 may be optionally awarded even if the community bonus game symbol 730 does not form a part of a winning outcome along an active pay line. In other words, in such aspects, so long as the winning outcome along an active pay line exceeds a predetermined minimum threshold, a community bonus game symbol 730 anywhere in the symbol array is realized and is awarded to the player.

The community bonus game symbol 730, as shown, may accrue the stated benefit if the symbol is shown, in isolation, in any symbol position on any reel, regardless of whether or not the symbol position bearing the community bonus game symbol forms a part of a winning combination along a selected payline. Alternatively, it may be required that the stated benefit is only realized by the player if the symbol position bearing the community bonus game symbol 730 forms a part of a winning combination along a selected payline or only if the community bonus game symbol falls on a specified symbol position or range of symbol positions (e.g., a specified reel). Further, to achieve the stated benefit, the player may optionally be required to wager a minimum threshold amount on that payline.

Of course, these same concepts apply equally to other community bonus game symbol 730 that may be optionally or additionally provided in the set of available symbols for a particular wagering game or a particular bonus game. For example, a special symbol or a plurality of special symbols may be provided in a base wagering game or associated bonus game for any aspect(s) of enhanced eligibility for a community bonus game, such as the "BIG EVENT BONUS," or increased awards (e.g., multiplier, etc.), or increased odds at winning an award or awards in the community bonus game. To illustrate, the base wagering game represented in FIGS. 11-13 could include a plurality of different community bonus game symbols 730, such as "BIG EVENT MULTIPLIER BOOST" symbols with specified amounts of "boost," such as a 1.5× boost, a 2× boost, or a 3× boost. The community bonus game symbols 730 could also or alternatively include "ELIGIBILITY BONUS" symbols with a predetermined amounts of eligibility (e.g., a fixed number of time slices, a predetermined number of time slices based on a look-up table in accord with the presence of the symbol in a winning combination, etc.) or randomly determined amounts of additional eligibility.

Additionally or alternatively, the base wagering game represented in FIGS. 11-13 could be associated with a bonus game, such as a free-spin bonus game, in which community bonus game symbols 730 are provided to permit the player to accrue additional eligibility and/or community bonus game benefits (e.g., awards, odds, multipliers, etc.) during play of the bonus game. In another example, a bonus game comprising a picking game, such as JACKPOT PARTY®, including one or more selectable elements associated with an outcome that permits the player to accrue additional eligibility and/or community bonus game benefits, such as noted above. In still another example, the bonus game could comprise a card-based game, such as Jacks or Better game (see, e.g., FIGS. 5-9) wherein specific cards are associated with a community bonus game symbol 730, token, or the like. In another aspect of bonus game play that permits a player to accrue additional eligibility and/or community bonus game benefits, the bonus game may comprise a plurality of levels (e.g., hands of cards, picking screens, episode in a persistent state gaming episodic game, etc.) and a player's completion of each level itself may provide the player with additional eligibility and/or community bonus game benefits preferably, but not necessarily, increasing in magnitude with each successive level.

Any manner of presentation of the community bonus game symbol 730 is possible in accord with the present concepts and is not limited to the depicted presentation with the community bonus game symbol 730 as a separate symbol. In other aspects, the community bonus game symbol 730 could comprise a watermark to one or more other symbols or could comprise a symbol superimposed on or partially superimposed on another symbol. As one example, the superposition could include, for example, a superposition of a small community bonus game symbol 730 to partially overlap another displayed symbol on a traditional display. In another example, a transmissive video display could be provided in front of a primary display 14 comprising a mechanical-reel display, a video display, or a combination thereof such that the transmissive video display portrays a video image superimposed over the mechanical-reel display. An example of a transmissive display is disclosed in U.S. Pat. No. 6,517,433 to Loose et al. entitled "Reel Spinning Slot Machine With Superimposed Video Image," which is incorporated herein by reference in its entirety. The transmissive display may permit still further variants on the incorporation of the community bonus game symbol or associated function into a slots based wagering game, such as by providing a community bonus game symbol 730 in a second chance spin of one or more reels displayed on the transmissive display.

In one embodiment, a gaming system for playing a wagering game a gaming machine 10 comprises a controller coupled programmed to increment, only during bonus game play, a bonus-time eligibility counter for a community bonus game and/or a benefit associated with the community bonus game (e.g., multiplier, awards, odds, etc.) responsive to an occurrence of a community bonus game symbol during play of the bonus game. In such an embodiment, the player's only avenue to the community bonus game is through the accumulation of time slices in the bonus game. The number and/or duration of the size of the time slices awarded in such an embodiment would sufficiently large so that a player achieving a benefit of bonus-time eligibility in the bonus game would retain eligibility for the community bonus game for an appreciable time during play of the base wagering game. The amount of bonus-time eligibility available in the bonus game may be less than, equal to, or may exceed, the time statistically required for the player to again trigger the bonus game. In various aspects of this embodiment, the bonus game could comprise one or more free spins of a plurality of symbol-bearing reels, one or more spins of an award wheel, one or more player selections of player-selectable elements concealing associated awards, a deal of one or more hands of cards to a player, or one or more turns moving a token along a game board having stations bearing award indicia. In these various aspects, a community bonus game symbol 730 or corresponding indicia of a community bonus game benefit may be associated with a reel symbol, a wheel award, a revealed award for a player-selected player-selectable element, a card dealt to or drawn by a player, or an indicia associated with a station on a game board. Moreover, a plurality of opportunities to obtain a community bonus game symbol 730 or corresponding indicia of a community bonus game benefit may be provided. For example, where a player is presented with an array of player-selectable elements, a plurality of these player-selectable elements may be associated with a community bonus game symbol 730 or corresponding indicia of a community bonus game benefit. Thus, a player may select in the bonus game player-selectable elements revealing a credit award, followed by a "3 minute boost" and a "5× multiplier".

Each of these embodiments and obvious variations thereof, such as any combination of any of the concepts, aspects, or embodiments disclosed herein, in whole or in part, is contemplated as falling within the spirit and scope of the claimed invention, which is set forth in the following claims. By way of example, the present concepts include a computer readable storage medium encoded with instructions for directing a gaming system to perform a method comprising any of the acts recited herein or in the following claims, in any combination. As another example, the present concepts further include equalizing an EV across a plurality of gaming machines configured to execute wagering games having different EVs by requiring different extra wagers from different gaming machines to obtain the same level of enhancements relative to eligibility for and/or benefits in the community event bonus game (e.g., a "Jacks or Better" player may be given x time slices for a two credit extra wager (above a "Max Bet" wager), whereas a "Deuces Wild" player may be given the same x time slices for a three credit extra wager.

Figure 14:
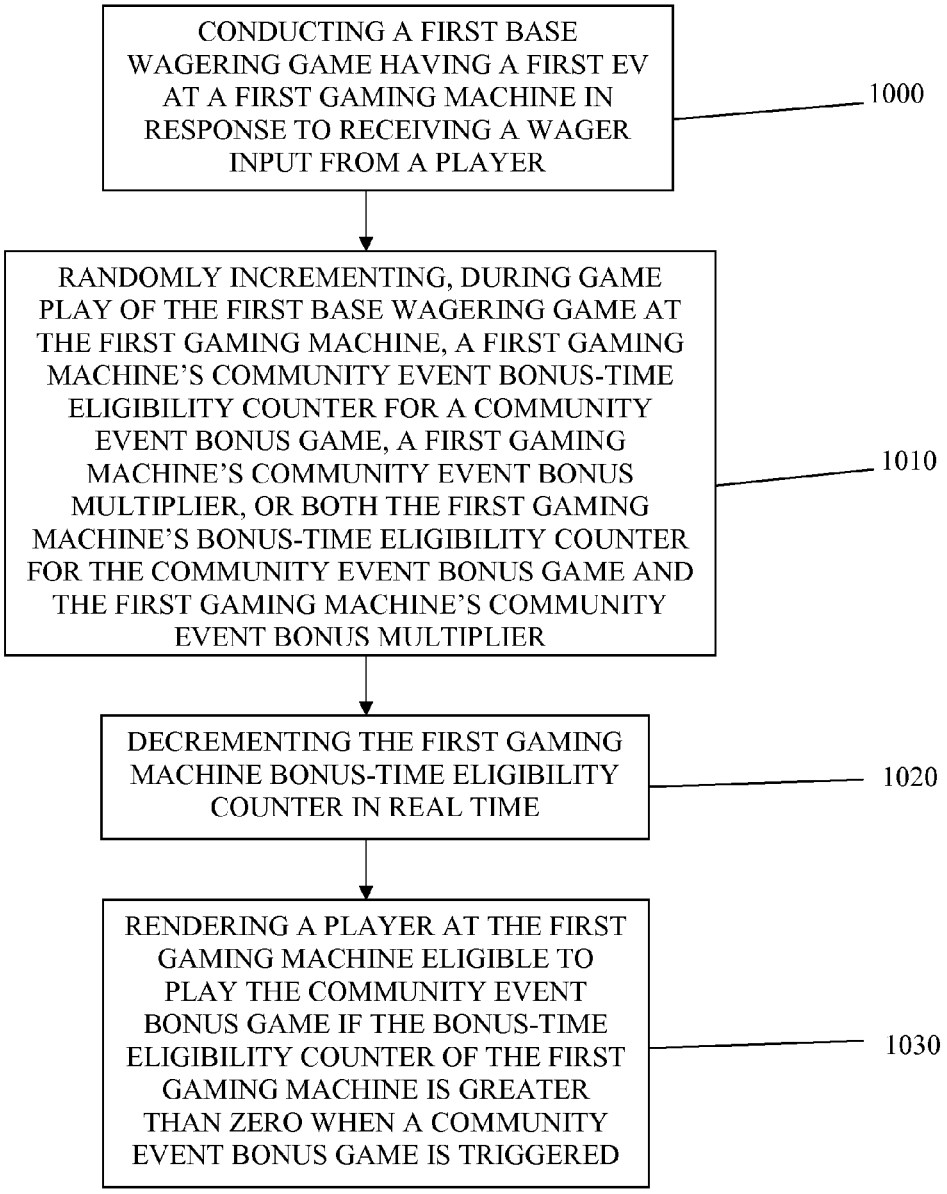
FIG. 14 depicts acts in a method of conducting a wagering game on a gaming system in accord with at least one aspect of the present concepts.

FIG. 14 depicts a method of conducting a wagering game on a gaming system, the method comprising an act of conducting a first base wagering game having a first EV at a first gaming machine in response to receiving a wager input from a player (act 1000) and an act 1010 of randomly incrementing, during game play of the first base wagering game at the first gaming machine, a first gaming machine's community event bonus-time eligibility counter for a community event bonus game, a first gaming machine's community event bonus multiplier, or both the first gaming machine's bonus-time eligibility counter for the community event bonus game and the first gaming machine's community event bonus multiplier. The method also includes the act 1020 of decrementing the first gaming machine bonus-time eligibility counter in real time and the act 1030 of rendering a player at the first gaming machine eligible to play the community event bonus game if the bonus-time eligibility counter of the first gaming machine is greater than zero when a community event bonus game is triggered.

What is claimed is:

1. A method of conducting a wagering game on a gaming system, the method comprising:

initiating a first base wagering game having a first EV at a first gaming machine in response to receipt of an input wager;

using a wagering game controller, incrementing a first gaming machine bonus-time eligibility counter;

using the wagering game controller, randomly incrementing, during game play of the first base wagering game at the first gaming machine, the incremented first gaming machine bonus-time eligibility counter;

using the wagering game controller, decrementing the incremented first gaming machine bonus-time eligibility counter in real time; and using the wagering game controller, rendering a player at the first gaming machine eligible to play the community event bonus game if the incremented first gaming machine bonus-time eligibility counter is non-zero when a community event bonus game is triggered.

2. The method of conducting a wagering game on a gaming system according to claim 1, further comprising:

using the wagering game controller or another wagering game controller, initiating a second base wagering game having a second EV at a second gaming machine in response to receipt of an input wager;

using the wagering game controller or the another wagering game controller, incrementing a second gaming machine bonus-time eligibility counter for a community event bonus game, responsive to the receipt of the input wager, to yield an incremented second gaming machine bonus-time eligibility counter;

using the wagering game controller or the another wagering game controller, randomly incrementing, during game play of the second base wagering game at the second gaming machine, the incremented second gaming machine bonus-time eligibility counter;

using the wagering game controller or the another wagering game controller, decrementing the incremented second gaming machine bonus-time eligibility counter in real time; and using the wagering game controller or the another wagering game controller, rendering a player at the second gaming machine eligible to play the community event bonus game if the incremented second gaming machine bonus-time eligibility counter is non-zero when a community event bonus game is triggered.

3. The method of conducting a wagering game on a gaming system according to claim 2, wherein the first EV and the second EV are substantially equal, and wherein the act of randomly incrementing is at least substantially equally applied to each of the first base wagering game and the second base wagering game.

4. The method of conducting a wagering game on a gaming system according to claim 2, wherein the first EV and the second EV are different, and wherein the act of randomly incrementing is at least substantially equally applied to each of the first base wagering game and the second base wagering game.

5. The method of conducting a wagering game on a gaming system according to claim 2, wherein the first EV is higher than the second EV, and wherein the act of randomly incrementing for the second base wagering game is executed at a higher frequency than the act of randomly incrementing for the first base wagering game.

6. The method of conducting a wagering game on a gaming system according to claim 2, wherein the first EV is higher than the second EV, and wherein the act of randomly incrementing for the second base wagering game is configured to award, on average, higher incremental values for the incremented second gaming machine bonus-time eligibility counter.

7. The method of conducting a wagering game on a gaming system according to claim 2, further comprising:

incrementing, during game play of the first base wagering game at the first gaming machine, a first gaming machine community event bonus multiplier, and incrementing, during game play of the second base wagering game at the second gaming machine, a second gaming machine community event bonus multiplier.

8. The method of conducting a wagering game on a gaming system according to claim 7, wherein the wagering game controller or the another wagering game controller is configured to award, on average, higher community event bonus multipliers for the second gaming machine than for the first wagering game.

9. The method of conducting a wagering game on a gaming system according to claim 1, wherein the act of randomly incrementing comprises randomly incrementing the incremented first gaming machine bonus-time eligibility counter responsive to a randomly determined outcome achieved during game play of the first base wagering game at the first gaming machine.

10. The method of conducting a wagering game on a gaming system according to claim 1, wherein the act of randomly incrementing comprises incrementing the incremented first gaming machine bonus-time eligibility counter responsive to a plurality of randomly determined outcomes achieved during game play of the first base wagering game at the first gaming machine.

11. The method of conducting a wagering game on a gaming system according to claim 1, wherein the act of randomly incrementing comprises incrementing the incremented first gaming machine bonus-time eligibility counter independent of any predetermined pay table wagering game outcome or player input.

12. The method of conducting a wagering game on a gaming system according to claim 1, further comprising:

incrementing the incremented first gaming machine bonus-time eligibility counter responsive to an input wager.

13. A gaming system configured to conduct one or more base wagering games and a community event bonus game on one or more wagering game machines, comprising:

a first wagering game machine comprising a first display configured to display a first base wagering game in response to receipt of a wager at the first wagering game machine; and a controller communicatively coupled to the first wagering game machine and programmed to initiate the first base wagering game having a first EV at the first wagering game machine in response to the receipt of the wager;

randomly increment, after receipt of the wager and during game play of the base wagering game at the first wagering game machine, a first wagering game machine bonus-time eligibility counter to yield an incremented first wagering game machine bonus-time eligibility counter;

decrement the incremented first wagering game machine bonus-time eligibility counter in real time; and render a player at the first wagering game machine eligible to play the community event bonus game if the incremented first wagering game machine bonus-time eligibility counter of the first wagering game machine is non-zero when a community event bonus game is triggered.

14. The gaming system according to claim 13, wherein the controller communicatively coupled to the first wagering game machine is further programmed to perform acts comprising:

initiate a second base wagering game having a second EV at a second wagering game machine in response to receipt of a wager at the second wagering game machine;

randomly increment, after receipt of the wager and during game play of the second base wagering game at the second gaming machine, the second wagering game machine bonus-time eligibility counter to yield an incremented second wagering game machine bonus-time eligibility counter;

decrement the incremented second wagering game machine bonus-time eligibility counter in real time; and render a player at the second wagering game machine eligible to play the community event bonus game if the incremented second wagering game machine bonus-time eligibility counter of the second gaming machine is non-zero when a community event bonus game is triggered.

15. The gaming system according to claim 14, wherein the first EV and the second EV are substantially equal, and wherein the act of randomly incrementing is at least substantially equally applied to each of the first base wagering game and the second base wagering game.

16. The gaming system according to claim 14, wherein the first EV and the second EV are different, and wherein the act of randomly incrementing is at least substantially equally applied to each of the first base wagering game and the second base wagering game.

17. The gaming system according to claim 14, wherein the first EV is higher than the another EV, and wherein the act of randomly incrementing for the second base wagering game is executed at a higher frequency than the act of randomly incrementing for the first base wagering game.

18. The gaming system according to claim 14, wherein the first EV is higher than the second EV, and wherein the act of randomly incrementing for the second base wagering game is configured to award, on average, higher incremental values for the incremented second wagering game machine bonus-time eligibility counter.

19. The gaming system according to claim 14, wherein the first EV is higher than the second EV.

20. The gaming system according to claim 13, wherein the act of randomly incrementing comprises incrementing the first wagering game machine bonus-time eligibility counter responsive to a randomly determined outcome achieved during game play of the first base wagering game at the first wagering game machine.

21. The gaming system according to claim 13, wherein the controller coupled to the first wagering game machine is further programmed to perform acts comprising:

incrementing the incremented first wagering game machine bonus-time eligibility counter responsive to an input wager.

22. The gaming system according to claim 13, wherein the incrementing of the first gaming machine bonus-time eligibility counter for a community event bonus game responsive to the receipt of the wager is proportional to the input wager, with larger wagers providing greater increments to the first gaming machine bonus-time eligibility counter than smaller wagers.

23. A method of conducting a wagering game on a wagering game system, the method comprising the acts of:

using a wagering game system controller, registering a wager input via a wager input device at a first wagering game machine;

using the wagering game system controller, after receipt of the wager, randomly incrementing the first wagering game machine bonus-time eligibility counter for the community event bonus game, the act of randomly incrementing the first wagering game machine bonus-time eligibility counter occurring during game play of the base wagering game;

using the wagering game system controller, decrementing the wagering game machine bonus-time eligibility counter at least during game play of the base wagering game; and using the wagering game system controller, rendering the first wagering game machine eligible to play the community event bonus game if the first wagering game machine bonus-time eligibility counter is a non-zero value when a community event bonus game is triggered.

* * * * *